US007217486B2

(12) United States Patent
Kato et al.

(10) Patent No.: US 7,217,486 B2
(45) Date of Patent: May 15, 2007

(54) TONER AND IMAGE-FORMING APPARATUS USING THE TONER

(75) Inventors: Hiroshi Kato, Nagano (JP); Nobuhiro Miyakawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 194 days.

(21) Appl. No.: 10/758,091

(22) Filed: Jan. 16, 2004

(65) Prior Publication Data

US 2004/0219448 A1 Nov. 4, 2004

(30) Foreign Application Priority Data

| | | |
|---|---|---|
| Jan. 17, 2003 | (JP) | 2003-009905 |
| Feb. 5, 2003 | (JP) | 2003-028678 |
| Feb. 5, 2003 | (JP) | 2003-028679 |
| Feb. 6, 2003 | (JP) | 2003-029571 |
| Feb. 17, 2003 | (JP) | 2003-038280 |

(51) Int. Cl.
*G03G 9/08* (2006.01)

(52) U.S. Cl. ..... 430/108.6; 430/108.7; 430/137.1; 430/108.8

(58) Field of Classification Search ..... 430/108.6, 430/108.7, 108.3, 108.4, 137.1, 137.21, 108.8
See application file for complete search history.

(56) References Cited

U.S. PATENT DOCUMENTS

| | | | | |
|---|---|---|---|---|
| 5,202,209 | A * | 4/1993 | Winnik et al. | 430/108.5 |
| 6,087,059 | A | 7/2000 | Duggan et al. | |
| 6,187,489 | B1 | 2/2001 | Oishi et al. | |
| 6,291,121 | B1 * | 9/2001 | Hollenbaugh et al. | 430/108.7 |
| 6,338,929 | B1 | 1/2002 | Hagi et al. | |
| 6,756,173 | B2 * | 6/2004 | Proper | 430/111.4 |
| 6,875,550 | B2 * | 4/2005 | Miyakawa et al. | 430/108.6 |
| 6,994,942 | B2 * | 2/2006 | Miyakawa et al. | 430/108.1 |
| 7,083,889 | B2 * | 8/2006 | Yamazaki et al. | 430/109.4 |
| 2003/0157419 | A1 * | 8/2003 | Miyakawa et al. | 430/108.6 |

FOREIGN PATENT DOCUMENTS

| | | | |
|---|---|---|---|
| JP | 03-116054 | | 5/1991 |
| JP | 8-33681 | B2 | 3/1996 |
| JP | 2502353 | B2 | 3/1996 |
| JP | 9-114129 | A | 5/1997 |
| JP | 2759510 | B2 | 3/1998 |
| JP | 11-231571 | A | 8/1999 |
| JP | 11-323396 | A | 11/1999 |
| JP | 2000-181118 | | 6/2000 |
| JP | 2000-267337 | | 9/2000 |
| JP | 2000-267337 | A | 9/2000 |
| JP | 2000-267357 | | 9/2000 |
| JP | 2001-022119 | | 1/2001 |
| JP | 2001-100452 | | 4/2001 |
| JP | 2001-100452 | A | 4/2001 |
| JP | 2001-296688 | A | 10/2001 |
| JP | 2002-14487 | A | 1/2002 |
| JP | 2002-72544 | A | 3/2002 |
| JP | 2002-202622 | A | 7/2002 |
| JP | 2002-214834 | A | 7/2002 |
| JP | 2002-287419 | | 10/2002 |

* cited by examiner

*Primary Examiner*—John L Goodrow
(74) *Attorney, Agent, or Firm*—Sughrue Mion, PLLC

(57) ABSTRACT

The present invention provides a toner containing toner mother particles containing a binder resin and a colorant having added thereinto external additives, e.g., positively electrifiable silica fine particles, negatively electrifiable silica fine particles, titanium oxide fine particles and a long chain fatty acid or a salt thereof, wherein the external additives are added by multistage process, thereby is low in desorption of external additives, has the electrification property for a long period of time, shows high flowability and transfer efficiency, and is not accompanied by the reduction of image density.

10 Claims, No Drawings

TONER AND IMAGE-FORMING APPARATUS USING THE TONER

FIELD OF THE INVENTION

The present invention relates to a toner which is used for developing an electrostatic latent image in electrophotography, electrostatic recording and electrostatic printing and for forming an image by thermal fixation, and also relates to an image-forming apparatus using the toner.

BACKGROUND OF THE INVENTION

The toner for forming electrostatic images generally comprises, as the toner mother particles, fine particles of a binder resin containing a coloring component, e.g., a dye or a pigment, and, if necessary, a charge controlling agent, and the toner is obtained by a method of adding external additives to the outside (surface) of the toner mother particles for the purpose of providing flowability or controlling an electrification property. As the external additives, positively electrifiable silica fine particles, negatively electrifiable silica fine particles, inorganic fine particles other than silica (e.g., titanium oxide), fatty acid metal salt and the like are used.

In general, the toner for forming electrostatic images is negatively charged. Such a toner is obtained by preparing negatively electrifiable toner mother particles and adding external additives, e.g., positively electrifiable silica fine particles, etc., to the negatively electrifiable toner mother particles, to thereby control the quantity of negative electrification (refer to, e.g., patent documents 1 to 3 set forth below). Alternatively, when from weakly negatively electrifiable toner mother particles to positively electrifiable toner mother particles are used, there is a method of adding external additives, such as negatively electrifiable silica fine particles, etc., to the above toner mother particles to control the quantity of negative electrification (refer to, e.g., patent documents 4 to 6).

As the methods of manufacturing a toner by using negatively electrifiable toner mother particles, a method of externally adding positively electrifiable hydrophobic silica fine particles to toner mother particles comprising a negatively electrifiable binder resin, a method of externally adding positively electrifiable hydrophobic silica fine particles and negatively electrifiable hydrophobic silica fine particles (refer to, e.g., patent documents 1 and 2), and a method of externally adding positively electrifiable hydrophobic silica fine particles and inorganic fine particles having a low electrical resistance value (refer to, e.g., patent document 3) are exemplified.

On the other hand, when weakly negatively electrifiable to positively electrifiable toner mother particles are used in manufacturing a toner, external addition methods are also examined. For example, a method of externally adding positively electrifiable hydrophobic silica fine particles and negatively electrifiable hydrophobic silica fine particles at the same time (refer to, e.g., patent document 4), and a method of externally adding a first component, a second component, a third component and a fourth component to toner mother particles at the same time, or externally adding the first component lastly, taking hydrophobic silica fine particles or hydrophobic titania as the first component, hydrophobic silica fine particles or hydrophobic titania having larger particle sizes than the particle sizes of component 1 as the second component, inorganic fine particles as the third component, and a fatty acid metal salt as the fourth component (refer to, e.g., patent document 5) are known.

Further, there is disclosed in a patent document a method to obtain a toner in which the isolation of external additives is restrained by externally adding in the order of titanium oxide fine particles and silica fine particles to toner mother particles (refer to, e.g., patent document 6).

However, in the toners obtained by the methods disclosed in patent documents 1 to 6, external additives (positively electrifiable silica fine particles, negatively electrifiable silica fine particles, titanium oxide fine particles and the like), which function to control electrification or flowability, are liable to be desorbed from the surface of the toner, which causes the reduction of flowability or electrification property of the toners, as a result, transfer efficiency and image density are depressed.

In addition, it is disclosed in patent documents 1 and 5 to use the metal salt of a fatty acid (a metal soap) in the toner for electrophotography, and the cases of using the metal salt of a fatty acid besides the above are also disclosed in patent documents 7 to 12. In patent document 5, a fatty acid metal salt is used in view of the prevention of fixing of a toner and generation of black spots on the surface of a photosensitive material, and then hydrophobic silica or hydrophobic titania is added. However, there is a problem that the external additive hydrophobic silica or hydrophobic titania is liberated, so that the stability of electrification cannot be maintained for a long period of time.

Patent document 7 perceived the binding property of a fatty acid metal salt and obtained a toner by the external addition step of only one time of the addition of a fatty acid metal salt with silica having amino groups on the surface at the same time. Although the toner obtained by this method is improved a little in the point of the rate of isolation of hydrophobic silica, a problem that the quantity of electrification of the toner cannot be maintained stably is still left behind. Patent documents 8 to 12 also disclose the use of fatty acid metal salts as the external additive in manufacturing toners. However, in any of the above patent document similarly to patent document 7, the fatty acid metal salts are added with other external additives at the same stage to obtain toners by the external addition process of only one time. The toners disclosed in patent documents 7 to 12 also have problems that the quantity of electrification of the toners cannot be maintained stably.

[Patent document 1]

JP-A-2000-267337 (the term "JP-A" as used herein means an "unexamined published Japanese patent application").

[Patent document 2]

JP-A-2002-14487

[Patent document 3]

JP-A-2002-214834

[Patent document 4]

JP-A-11-231571

[Patent document 5]

JP-A-2001-100452

[Patent document 6]

JP-A-2002-72544

[Patent document 7]

Japanese Patent 2502353

[Patent document 8]

JP-B-8-33681 (the term "JP-B" as used herein means an "examined Japanese patent publication").

[Patent document 9]

Japanese Patent 2759510

[Patent document 10]
JP-A-9-114129
[Patent document 11]
JP-A-11-323396
[Patent document 12]
JP-A-2001-296688
[Patent document 13]
JP-A-2002-202622

An object of the present invention is to provide a toner which is low in desorption of external additives (e.g., positively electrifiable silica fine particles, negatively electrifiable silica fine particles, titanium oxide fine particles and the like), can maintain the electrification property for a long period of time, shows high flowability and transfer efficiency, and is not accompanied by the reduction of image density. Additionally, an object of the present invention is also to provide an image-forming apparatus using the toner.

SUMMARY OF THE INVENTION

In a first aspects of the present invention (hereinafter referred to as "first invention"), the first invention mainly relates to the following items.

1) A toner obtained by a process comprising, in the following order:

a step of externally adding negatively electrifiable silica fine particles to toner mother particles containing a binder resin and a colorant;

a step of externally adding titanium oxide fine particles; and a step of externally adding positively electrifiable silica fine particles.

2) A toner obtained by a process comprising, in the following order:

a step of externally adding negatively electrifiable silica fine particles to toner mother particles containing a binder resin and a colorant;

a step of externally adding titanium oxide fine particles;

a step of externally adding positively electrifiable silica fine particles; and a step of externally adding particles comprising a long chain fatty acid or a salt thereof.

3) A toner obtained by a process comprising, in the following order:

a step of externally adding negatively electrifiable silica fine particles to toner mother particles containing a binder resin and a colorant;

a step of externally adding titanium oxide fine particles; and a step of externally adding positively electrifiable silica fine particles and particles comprising a long chain fatty acid or a salt thereof.

4) The toner according to any one of items 1 to 3, wherein the negatively electrifiable silica fine particles comprise two kinds of negatively electrifiable silica fine particles having different average particle sizes from each other, and the addition amount ratio of the negatively electrifiable silica fine particles having a larger average particle size to the negatively electrifiable silica fine particles having a smaller average particle size is 1/3 to 3/1 by weight.

5) The toner according to any one of items 1 to 3, wherein the titanium oxide fine particles and the positively electrifiable silica fine particles are externally added in a weight ratio thereof of from 1/3 to 3/1.

6) The toner according to any one of items 1 to 3, wherein the titanium oxide fine particles are rutile-anatase type titanium oxide fine particles.

7) An image-forming apparatus comprising a toner according to any one of items 1 to 3.

8) The image-forming apparatus according to item 7, wherein the image-forming apparatus further comprises:

a latent image carrier on which an electrostatic latent image is formed;

a toner carrier for carrying a toner to the latent image carrier for developing the electrostatic latent image on the latent image carrier; and a development unit having a toner regulating member to regulate the amount of the toner carried to the latent image carrier by the toner carrier.

In a second aspect of the present invention (hereinafter referred to as "second invention"), the second invention mainly relates to the following items.

9) A toner obtained by a process comprising, in the following order:

a step of externally adding negatively electrifiable silica fine particles to toner mother particles containing a binder resin and a colorant; and a step of externally adding titanium oxide fine particles, positively electrifiable silica fine particles, and particles comprising a long chain fatty acid or a salt thereof.

10) The toner according to item 9, wherein the negatively electrifiable silica fine particles comprise two kinds of negatively electrifiable silica fine particles having different average particle sizes from each other, and the addition amount ratio of the negatively electrifiable silica fine particles having a larger average particle size to the negatively electrifiable silica fine particles having a smaller average particle size is 1/3 to 3/1 by weight.

11) The toner according to item 9, wherein the titanium oxide fine particles and the positively electrifiable silica fine particles are externally added in a weight ratio thereof of from 1/3 to 3/1.

12) The toner according to any of item 9, wherein the titanium oxide fine particles are rutile-anatase type titanium oxide fine particles.

13) An image-forming apparatus comprising a toner according to item 9.

14) The image-forming apparatus according to item 13, wherein the image-forming apparatus further comprises:

a latent image carrier on which an electrostatic latent image is formed;

a toner carrier for carrying a toner to the latent image carrier for developing the electrostatic latent image on the latent image carrier; and a development unit having a toner regulating member to regulate the amount of the toner carried to the latent image carrier by the toner carrier.

In a third aspect of the present invention (hereinafter referred to as "third invention"), the third invention mainly relates to following items.

15) A toner obtained by a process comprising, in the following order:

a step of externally adding negatively electrifiable silica fine particles to toner mother particles containing a binder resin and a colorant; and a step of externally adding positively electrifiable silica fine particles.

16) The toner according to item 15, wherein the negatively electrifiable silica fine particles comprise two kinds of negatively electrifiable silica fine particles having different average particle sizes from each other, and the addition ratio of the negatively electrifiable silica fine particles having a larger average particle size to the negatively electrifiable silica fine particles having a smaller average particle size is 1/3 to 3/1 by weight.

17) The toner according to item 15, wherein the negatively electrifiable silica fine particles and the positively electrifiable silica fine particles are externally added in a weight ratio thereof of from 1/1 to 30/1.

18) An image-forming apparatus comprising a toner according to item 15.

19) The image-forming apparatus according to item 18, wherein the image-forming apparatus further comprises:

a latent image carrier on which an electrostatic latent image is formed;

a toner carrier for carrying a toner to the latent image carrier for developing the electrostatic latent image on the latent image carrier; and a development unit having a toner regulating member to regulate the amount of the toner carried to the latent image carrier by the toner carrier.

In a fourth aspect of the present invention (hereinafter referred to as "fourth invention"), the fourth invention mainly relates to following items.

20) A toner comprising negatively electrifiable toner mother particles having externally added thereto:

positively electrifiable silica fine particles;

titanium oxide fine particles; and particles comprising a long chain fatty acid or a salt thereof.

21) The toner according to item 20, wherein the toner mother particles have a quantity of electrification of from −5 to −60 μC/g.

22) The toner according to item 20, wherein the positively electrifiable silica fine particles, titanium oxide fine particles, and particles comprising a long chain fatty acid or a salt thereof are externally added to the toner mother particles at the same time.

23) The toner according to item 20, wherein the toner is obtained by a process comprising, in the following order:

a step of externally adding the positively electrifiable silica fine particles; and a step of externally adding the titanium oxide fine particles and particles comprising a long chain fatty acid or a salt thereof.

24) The toner according to item 20, wherein the positively electrifiable silica fine particles and the titanium oxide fine particles are added in a weight ratio thereof of from 1/3 to 3/1.

25) An image-forming apparatus comprising a toner according to item 20.

26) The image-forming apparatus according to item 25, wherein the image-forming apparatus further comprises:

a latent image carrier on which an electrostatic latent image is formed;

a toner carrier for carrying a toner to the latent image carrier for developing the electrostatic latent image on the latent image carrier; and a development unit having a toner regulating member to regulate the amount of the toner carried to the latent image carrier by the toner carrier.

In a fifth aspect of the present invention (hereinafter referred to as "fifht invention"), the fifth invention mainly relates to following items.

27) A toner comprising:

toner mother particles comprising a binder resin and a colorant; and external additives added to the toner mother particles, wherein the external additives are added by multistage process, and at least particles comprising a long chain fatty acid or a salt thereof are added in the last stage of the multistage process.

28) The toner according to item 27, wherein at least one external additive selected from the group consisting of negatively electrifiable silica fine particles, titanium oxide and positively electrifiable silica fine particles is added to the toner mother particles, and at least the particles comprising a long chain fatty acid or a salt thereof are added to the toner mother particles in the last stage of the multistage process.

29) The toner according to item 27, wherein negatively electrifiable silica fine particles are added to the toner mother particles in the first stage of the multistage process.

30) The toner according to item 29, wherein the multistage process is a process comprising, in the following order:

a step of adding negatively electrifiable silica fine particles to the toner mother particles;

a step of adding titanium oxide fine particles;

a step of adding positively electrifiable silica fine particles; and a step of adding particles comprising a long chain fatty acid or a salt thereof.

31) The toner according to item 29, wherein the multistage process is a process comprising, in the following order:

a step of adding negatively electrifiable silica fine particles to the toner mother particles;

a step of adding titanium oxide fine particles; and a step of adding positively electrifiable silica fine particles and particles comprising a long chain fatty acid or a salt thereof.

32) The toner according to item 29, wherein the multistage process is a process comprising:

a step of adding negatively electrifiable silica fine particles to the toner mother particles;

a step of adding titanium oxide fine particles; and a step of adding particles comprising a long chain fatty acid or a salt thereof.

33) The toner according to item 29, wherein the multistage process is a process comprising, in the following order:

a step of adding negatively electrifiable silica fine particles to the toner mother particles; and a step of adding titanium oxide fine particles, positively electrifiable silica fine particles and particles comprising a long chain fatty acid or a salt thereof at the same stage.

34) The toner according to item 27, wherein negatively electrifiable silica fine particles and titanium oxide fine particles are added to the toner mother particles in the first stage of the multistage process.

35) The toner according to item 27, wherein titanium oxide fine particles are added to the toner mother particles in the first stage of the multistage process.

36) The toner according to item 27, wherein the toner mother particles are negatively charged.

37) The toner according to item 36, wherein the toner mother particles have a quantity of electrification of from −5 to −60 μC/g.

38) The toner according to item 36, wherein the multistage process is a process comprising, in the following order:

a step of adding a additive comprising at least positively electrifiable silica fine particles to the negatively charged toner mother particles in the first stage of the multistage process; and a step of adding at least the particles comprising a long chain fatty acid or a salt thereof in the last stage of the multistage process.

39) The toner according to item 38, wherein the process comprises a step of adding negatively electrifiable silica fine particles before the particles comprising a long chain fatty acid or a salt thereof.

40) The toner according to item 38, wherein the multistage process is a process comprising, in the following order:

a step of adding the positively electrifiable silica fine particles to the negatively charged toner mother particles; and a step of adding titanium oxide fine particles and the particles comprising a long chain fatty acid or a salt thereof at the same stage.

41) The toner according to item 38, wherein the multistage process is a process comprising, in the following order:

a step of adding the positively electrifiable silica fine particles to the negatively charged toner mother particles;

a step of adding titanium oxide fine particles; and a step of adding the particles comprising a long chain fatty acid or a salt thereof.

42) An image-forming apparatus comprising a toner according to items 27.

43) The image-forming apparatus according to item 42, wherein the image-forming apparatus further comprises:

a latent image carrier on which an electrostatic latent image is formed;

a toner carrier for carrying a toner to the latent image carrier for developing the electrostatic latent image on the latent image carrier; and a development unit having a toner regulating member to regulate the amount of the toner carried to the latent image carrier by the toner carrier.

DETAILED DESCRIPTION OF THE INVENTION

The toner in the present invention is a toner obtained by the addition of external additives, the external additives are added by multistage process.

In the specification of the present invention, materials externally added to toner mother particles, e.g., negatively electrifiable silica fine particles, positively electrifiable silica fine particles, titanium oxide fine particles, and particles comprising a long chain fatty acid or a salt thereof are referred to as external additives, and adding these external additives to the exteriors (surfaces) of toner mother particles is called external addition.

First Invention

The toner of the first invention is obtained by adding materials, e.g., negatively electrifiable silica fine particles, positively electrifiable silica fine particles, titanium oxide fine particles, and particles comprising a long chain fatty acid or a salt thereof to toner mother particles in a specific order.

Second Invention

The toner of the second invention is obtained by adding negatively electrifiable silica fine particles to toner mother particles, and then adding titanium oxide fine particles, positively electrifiable silica fine particles, and particles comprising a long chain fatty acid or a salt thereof at the same time.

Third Invention

The toner of the third invention is obtained by adding negatively electrifiable silica fine particles to toner mother particles, and then adding positively electrifiable silica fine particles.

Fourth Invention

The toner of the fourth invention can be obtained by externally adding positively electrifiable silica, titanium oxide and particles comprising a long chain fatty acid or a salt thereof to negatively electrifiable toner mother particles, preferably toner mother particles having a quantity of electrification of from −5 to −60 μC/g. If necessary, inorganic fine particles other than titanium oxide are externally added.

Fifth Invention

The toner in the fifth invention is a toner obtained by the addition of external additives, the external additives are added by multistage process, and the toner is obtained by adding the external additives containing particles comprising at least a long chain fatty acid or a salt thereof to toner mother particles in the last stage of the multistage process. In the toner obtained by adding particles comprising at least a long chain fatty acid or a salt thereof in the last stage, the isolation of the externally added external additives is controlled by the long chain fatty acid or the salt thereof, thereby the quantity of electrification of the toner can be maintained stably for a long period of time and also excellent in flowability. Further, by adding a long chain fatty acid or a salt thereof in the last stage of the toner manufacturing process and making the long chain fatty acid or the salt thereof present at the outermost shell of the toner mother particles, the adhesion of the toner with the photosensitive material or of the toner with the intermediate transfer belt in the developing chamber is reduced, thereby the transfer efficiency in the transfer step can be improved, and the abrasion of the photosensitive material and the intermediate transfer belt by the external additives on the surface of the toner can also be prevented.

The materials which are used in the present invention, e.g., (i) toner mother particles and the materials constituting the toner mother particles (so-called internal additives, e.g., binder resins, colorants, mold releasing agents, dispersants, charge controlling agents, and magnetic agents), (ii) negatively electrifiable silica fine particles, (iii) positively electrifiable silica fine particles, (iv) titanium oxide fine particles, (v) long chain fatty acids or salts thereof, and (vi) inorganic fine particles which are added according to necessity, are described in the first place, and then the toner of the present invention is described.

(I) Materials Which are Used in the Present Invention (i) Toner Mother Particles:

Toner mother particles contain a binder resin and a colorant and, if necessary, internal additives, e.g., a mold releasing agent, a dispersant, a charge controlling agent, and a magnetic agent. Toner mother particles are positively or negatively charged, preferably negatively charged. There are some methods to electrify toner mother particles so as to have an appropriate range of the quantity of negative electrification. For example, a method of blending a negative charge controlling agent with a positively electrifiable binder resin, a method of further blending a negative charge controlling agent when the electrification property of a negatively electrifiable resin is not sufficient, or a method of making a binder resin itself negatively electrifiable resin. The materials which constitute toner mother particles and the manufacturing method of toner mother particles are described in order below.

(i-1) Materials Constituting Toner Mother Particles:

[Binder Resins]:

Considering the methods of electrifying toner mother particles negatively, any of positively electrifiable resins and negatively electrifiable resins can be used as binder resins. As such resins, resins which are ordinarily used as the materials of toners are used. For example, polystyrene-based resins, acrylate-based resins or methacrylate-based resins (hereinafter referred to as (meth)acrylate-based resins), styrene-acrylic-based resins, polyester resins, polyethylene resins, epoxy resins, silicone resins, polypropylene resins, fluorine resins, polyamide resins, polyvinyl alcohol resins, polyurethane resins, polyvinyl-butyral resins, and copolymers containing the constituents of these resins are used.

Of these resins, as positively electrifiable to weakly negatively electrifiable resins, polystyrene-based resins and styrene-(meth)acrylate-based resin copolymers are preferably used. As weakly negatively electrifiable to strongly negatively electrifiable resins, polyester resins are preferably used.

As polystyrene resins, e.g., hydrogenated styrene resins, styrene-isobutylene copolymers, acrylonitrile-butadiene-styrene copolymers (ABS resins), acrylonitrile-styrene copolymers (AS resins), acrylonitrile-polyethylene chloride-styrene copolymers (ACS resins), styrene-p-chlorostyrene copolymers, styrene-propylene copolymers, styrene-butadiene crosslinked polymers, styrene-butadiene-chlorinated paraffin copolymers, styrene-allyl alcohol copolymers, styrene-butadiene rubbers, styrene-maleic ester copolymers, styrene-isobutylene copolymers, and styrene-maleic anhydride copolymers are exemplified.

As styrene-(meth)acrylate-based resin copolymers, e.g., acrylate-styrene-acrylonitrile copolymers (ASA resins), styrene-diethylaminoethyl methacrylate copolymers, styrene-methyl methacrylate copolymers, styrene-n-butyl methacrylate copolymers, styrene-methyl methacrylate-n-butyl acrylate copolymers, styrene-methyl methacrylate-butyl allylate-N-(ethoxymethyl)acrylamide copolymers, styrene-glycidyl methacrylate copolymers, styrene-butadiene-dimethylaminoethyl methacrylate copolymers, styrene-acrylate-maleate copolymers, styrene-methyl methacrylate-2-ethylhexyl acrylate copolymers, styrene-n-butyl allylate-ethyl glycol methacrylate copolymers, styrene-n-butyl methacrylate-acrylic acid copolymers, styrene-n-butyl methacrylate-maleic anhydride copolymers, styrene-butyl acrylate-isobutylmaleic half ester-divinylbenzene copolymers, styrene-butadiene-acrylate copolymers, and styrene-acrylate copolymers are exemplified.

In general, negative charge controlling agents are added to these binder resins, thereby toner mother particles having an appropriate quantity of negative electrification are obtained.

These negatively electrifiable resins are relatively preferably used in manufacturing toner mother particles. In particular, when a strongly negatively electrifiable resin is used, it becomes possible to obtain good electrification characteristics without externally adding negatively electrifiable silica fine particles to toner mother particles, and the fixing temperature of the toner can be set at a low temperature.

As generally used negatively electrifiable resins, resins having a substituent, e.g., a carboxyl group, a phenyl group, a thiophenyl group or a sulfonic acid group, on the side chain are preferably used. It is preferred that these substituents take the form of a metal salt. As the metal salt, a metal salt with zinc, magnesium, aluminum, sodium, potassium, chromium, iron, manganese or cobalt is preferred. Alternatively, these substituents may be in the form of a salt with an organic base, e.g., an ammonium ion, a pyridinium ion or an imidazolium ion.

As the negatively electrifiable resins, polyester resins are most preferably used. Such polyester resins have a carboxyl group on the side chain which can be obtained by polycondensation of polyhydric alcohols with polyvalent carboxylic acids or derivatives thereof.

As the polyhydric alcohols which constitute polyester resins, dihydric alcohols, trihydric alcohols or tetrahydric or higher alcohols are used.

The examples of dihydric alcohols include ethylene glycol, 1,2-propylene glycol, 1,3-propylene glycol, 1,3-butylene glycol, 1,4-butylene glycol, 1,6-hexanediol, neopentyl glycol, diethylene glycol, dipropylene glycol, ethylene oxide adducts of bisphenol A and propylene oxide adducts of bisphenol A.

The examples of trihydric alcohols include glycerol, trimethylolpropane, trimethylolethane, 1,2,4-butanetriol, 1,2,5-pentanetriol, 2-methylpropanetriol, 2-methyl-1,2,4-butanetriol, and 1,3,5-trihydroxymethylbenzene.

The examples of tetrahydric or higher alcohols include sorbitol, 1,2,3,6-hexanetetraol, 1,4-sorbitan, pentaerythritol, dipentaerythritol and tripentaerythritol.

These polyhydric alcohols are used alone or as mixtures. Of these polyhydric alcohols, neopentyl glycol, trimethylolpropane, ethylene oxide adducts of bisphenol A and propylene oxide adducts of bisphenol A are preferably used.

As the polyvalent carboxylic acids which constitute the polyester resins, divalent carboxylic acids, trivalent or higher carboxylic acids and derivatives of these carboxylic acids are exemplified.

The examples of divalent carboxylic acids include malonic acid, succinic acid, glutaric acid, adipic acid, maleic acid, fumaric acid, itaconic acid, citraconic acid, phthalic acid, terephthalic acid and isophthalic acid. As the derivatives of divalent carboxylic acids, lower alkyl esters and acid anhydrides of these acids are used. As the lower alkyl esters, alkyl esters having from 1 to 12 carbon atoms, e.g., methyl esters and ethyl esters are preferably used.

Of these divalent carboxylic acids, divalent-carboxylic acids having an aromatic ring, e.g., phthalic acid, terephthalic acid, isophthalic acid, lower alkyl esters and acid anhydrides of these acids are preferably used.

The examples of trivalent or higher carboxylic acids include 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexatricarboxylic acid, 1,3-dicarboxyl-2-methyl-2-methylenecarboxypropane, tetra(methylenecarboxyl) methane, 1,2,7,8-octanetetracarboxylic acid, and pyromellitic acid. As the derivatives of these trivalent or higher carboxylic acids, lower alkyl esters and acid anhydrides of these carboxylic acids are exemplified.

The manufacturing methods of polyester resins are not particularly restricted, and they are manufactured by polycondensation of polyvalent carboxylic acids and polyhydric alcohols by the methods usually used in this industry. In polycondensation, the reacting weight of polyvalent carboxylic acids and polyhydric alcohols is preferably from 0.8 to 1.4 in the molar ratio of hydroxyl group to carboxyl group (OH/COOH). Further, it is preferred to adjust the acid value of the obtained polyester resin to 1 to 100, more preferably from 1 to 30. When the acid value is smaller than 1, the dispersibility of internal additives, e.g., a charge controlling agent, a mold releasing agent and a colorant, to the binder resin is reduced. When the acid value is higher than 100, the moisture resistance of the toner lowers. In addition, an acid value is measured by ordinary methods with KOH.

When the above polyester resin is used as the binder resin and, in particular, when offset resistance and transparency (smoothness of the fixed image) of a high level are desired, it is preferred to use a urethane-modified polyester resin as the polyester resin.

A urethane-modified polyester resin can be obtained by the reaction of a polyester resin with an isocyanate. The reaction is performed by the methods usually used in this industry. In the reaction, it is preferred to blend them so that the isocyanate becomes from 0.3 to 0.99 molar equivalent per molar equivalent of the hydroxyl group of a polyester resin, more preferably from 0.5 to 0.95 molar equivalent. When the molar ratio of the isocyanate is less than 0.3, the offset resistance may decrease. While when the molar ratio is more than 0.99, the viscosity conspicuously increases, so that stirring is sometimes difficult.

Isocyanates are not particularly limited, but hexamethylene diisocyanate, isophorone diisocyanate, tolylene diisocyanate, diphenylmethane diisocyanate, xylylene diisocyanate, and tetramethylxylylene diisocyanate are preferably used.

The weight average molecular weight of the binder resins which are used in the present invention is not especially restricted, but it is generally preferably from 2,000 to 30,000, more preferably from 4,000 to 25,000, and still more preferably from 6,000 to 20,000. When the molecular weight is less than 2,000, the viscosity lowers at blending, and a colorant cannot be dispersed sufficiently in some cases. Therefore, the chroma or transparency of the obtained toner is liable to lower. When the molecular weight is greater than 30,000, the viscosity becomes too high, so that a colorant cannot be dispersed sufficiently and the chroma or transparency of the toner is sometimes reduced. A plurality of binder resins having the above molecular weight may be mixed.

The molecular weight of binder resins is measured by gel permeation chromatography (GPC).

When a toner is fixed by thermal fixation in image formation, the softening temperature (Tm) of a binder resin is preferably low. Tm is preferably from 85 to 140°, more preferably from 90 to 120° C., and still more preferably from 100 to 110° C. The glass transition temperature (Tg) of a binder resin is preferably from 40 to 90° C., more preferably from 50 to 80° C. A softening temperature (Tm) is measured by using a sample obtained by pressure-molding 1.0 g of a binder resin to make a pellet, with "Flow Tester CFT-500D" (a product of Shimadzu Corporation) on conditions of: heat-up velocity of 5° C./min; cylinder pressure of 2.0 MPa; the hole diameter of a die of 1.0 mm; the hole length of a die of 1.0 mm; and by Tm computing method of a ½ method. Further, the glass transition temperature (Tg) of a binder resin is measured by packing 10 mg of a binder resin in an aluminum cell and with "DSC120" (a product of Seiko Instruments Inc.) on conditions of: measuring temperature of from 0 to 200° C.; and heat-up velocity of 10° C./min; and the value is read from the DSC curve of the second heat-up time.

When a toner is fixed by pressure fixation, wax-like resins are preferably used as the binder resin. Of the above binder resins, polyethylene resins, polyethylene-vinyl acetate copolymers and natural waxes are used as the wax-like resins.

The binder resins are manufactured by polymerization, e.g., emulsion polymerization, dispersion polymerization and suspension polymerization, or pulverization including kneading, pulverization and classification processes. Considering the homogeneity and flowability of the finally obtained toner particles, the binder resins obtained by polymerization are preferably used.

The binder resins may be used alone or two or more binder resins may be blended. The above-shown binder resins are representative examples and the present invention is not of course limited thereto.

[Colorants]:

As colorants, the following-shown organic pigments, inorganic pigments and dyes are used. Of organic and inorganic pigments, carbon black, copper oxide, tri-iron tetroxide, manganese dioxide, Aniline Black and active carbon are used as black pigments.

As yellow pigments, chrome yellow, zinc yellow, cadmium yellow, yellow iron oxide, mineral fast yellow, nickel titan yellow, naples yellow, Naphthol Yellow S, Hansa Yellow, Benzidine Yellow G, Benzidine Yellow GR, Quinoline Yellow Lake, Permanent Yellow NCG, and Tartrazine Lake are used.

As orange pigments, red chrome yellow, molybdenum orange, Permanent Orange GTR, Pyrazolone Orange, Vulcan Orange, Indanthrene Brilliant Orange RK, Benzidine Orange G, and Indanthrene Brilliant Orange GKM are used.

As red pigments, iron oxide red, cadmium red, red lead, mercury sulfide, cadmium, Permanent Red 4R, Lithol Red, Pyrazolone Red, Watchung Red, calcium salt, Lake Red D, Brilliant Carmine 6B, eosine lake, Rhodamine Lake B, Alizarine Lake and Brilliant Carmine 3B are used.

As violet pigments, manganese violet, Fast Violet B and Methyl Violet Lake are used. As blue pigments, Prussian blue, cobalt blue, Alkali Blue Lake, Victoria Blue Lake, Phthalocyanine Blue, nonmetal Phthalocyanine Blue, partially chlorinated product of Phthalocyanine Blue, Fast Sky Blue and Indanthrene Blue BC are used.

As green pigments, chrome green, chromium oxide, Pigment Green B, Malachite Green Lake and Final Yellow Green G are used.

As white pigments, zinc flower, titanium oxide, antimony white and zinc sulfide are used.

As extender pigments, baryta powder, barium carbonate, clay, silica, white carbon, talc and alumina white are used.

As dyes, basic dyes, acid dyes, dispersed dyes and direct dyes are used. The examples of such dyes include Nigrosine, Methylene Blue, Rose Bengale, Quinoline Yellow and Ultramarine Blue.

When the toner of the present invention is a transparent color toner, the following-shown various pigments and dyes are used as the colorants.

As yellow pigments, C.I. 10316 (Naphthol Yellow S), C.I. 11710 (Hansa Yellow 10G), C.I. 11660 (Hansa Yellow 5G), C.I. 11670 (Hansa Yellow 3G), C.I. 11680 (Hansa Yellow G), C.I. 11730 (Hansa Yellow GR), C.I. 11735 (Hansa Yellow A), C.I. 11740 (Hansa Yellow NR), C.I. 12710 (Hansa Yellow R), C.I. 12720 (Pigment Yellow L), C.I. 21090 (Benzidine Yellow), C.I. 21095 (Benzidine Yellow G), C.I. 21100 (Benzidine Yellow GR), C.I. 20040 (Permanent Yellow NCG), C.I. 21220 (Vulcan Fast Yellow 5) and C.I. 21135 (Vulcan Fast Yellow R) are used.

As red pigments, C.I. 12055 (Stirling I), C.I. 12075 (Permanent Orange), C.I. 12175 (Lithol Fast Orange 3GL), C.I. 12305 (Permanent Orange GTR), C.I. 11725 (Hansa Yellow 3R), C.I. 21165 (Vulcan Fast Orange GG), C.I. 21110 (Benzidine Orange G), C.I. 12120 (Permanent Red 4R), C.I. 1270 (Para Red), C.I. 12085 (Fire Red), C.I. 12315 (Brilliant Fast Scarlet), C.I. 12310 (Permanent Red F2R), C.I. 12335 (Permanent Red F4R), C.I. 12440 (Permanent Red FRL), C.I. 12460 (Permanent Red FRLL), C.I. 12420 (Permanent Red F4RH), C.I. 12450 (Light Fast Red Toner B), C.I. 12490 (Permanent Carmine FB), and C.I. 15850 (Brilliant Carmine 6B) are used.

As blue pigments, C.I. 74100 (nonmetal Phthalocyanine Blue), C.I. 74160 (Phthalocyanine Blue), and C.I. 74180 (Fast Sky Blue) are used.

These colorants may be used alone or a plurality of colorants may be used in combination. The colorants are used in an amount of from 1 to 20 wt. % to 100 wt. % of the binder resin, preferably from 2 to 10 wt. %. When the amount of colorants is more than 20 wt. %, the fixing property and transparency of the toner decrease, while when the amount is less than 1 wt. %, there is a risk of incapable of obtaining desired image density.

[Mold Releasing Agents]:

As the mold releasing agent, paraffin-based waxes, polyolefin-based waxes, modified waxes having an aromatic group, hydrocarbon compounds having an alicyclic group, natural waxes, long chain fatty acids having 12 or more carbon atoms, the esters thereof, metal salts of long chain fatty acids (metal soaps), fatty acid amide and fatty acid bisamide are used. Of the above mold releasing agents, paraffin-based waxes, polyolefin-based waxes and metal soaps are preferably used.

The examples of paraffin-based waxes include, e.g., paraffin wax (manufactured by Nippon Oil Co., Ltd. and Nippon Seiro Co., Ltd.), micro-wax (manufactured by Nippon Oil Co., Ltd.), micro-crystalline wax (manufactured by Nippon Seiro Co., Ltd.), hard paraffin wax (manufactured by Nippon Seiro Co., Ltd.), PE-130 (manufactured by Hoechst A.G.), MITSUI HI-WAX 110P (manufactured by Mitsui Petrochemical Industries, Ltd.), MITSUI HI-WAX 220P (manufactured by Mitsui Petrochemical Industries, Ltd.), MITSUI HI-WAX 660P (manufactured by Mitsui Petrochemical Industries, Ltd.), MITSUI HI-WAX 210P (manufactured by Mitsui Petrochemical Industries, Ltd.), MITSUI HI-WAX 320P (manufactured by Mitsui Petrochemical Industries, Ltd.), MITSUI HI-WAX 410P (manufactured by Mitsui Petrochemical Industries, Ltd.), MITSUI HI-WAX 420P (manufactured by Mitsui Petrochemical Industries, Ltd.), modified wax JC-1142 (manufactured by Mitsui Petrochemical Industries, Ltd.), modified wax JC-2130 (manufactured by Mitsui Petrochemical Industries, Ltd.), modified wax JC-4020 (manufactured by Mitsui Petrochemical Industries, Ltd.), modified wax JC-1142 (manufactured by Mitsui Petrochemical Industries, Ltd.), modified wax JC-5020 (manufactured by Mitsui Petrochemical Industries, Ltd.), beeswax, carnauba wax and montan wax.

As polyolefin-based waxes, e.g., low molecular weight polypropylene, low molecular weight polyethylene, oxidation type polypropylene and oxidation type polyethylene are exemplified. The specific examples of polyolefin-based waxes include non-oxidation type polyethylene waxes, e.g., Hoechst Wax PE520, Hoechst Wax PE130, Hoechst Wax PE190 (manufactured by Hoechst A.G.), MITSUI HI-WAX 200, MITSUI HI-WAX 210, MITSUI HI-WAX 210M, MITSUI HI-WAX 220, MITSUI HI-WAX 220M (manufactured by Mitsui Petrochemical Industries, Ltd.), SANWAX 131-P, SANWAX 151-P, and SANWAX 161-P (manufactured by Sanyo Chemical Industries Co., Ltd.), oxidation type polyethylene waxes, e.g., Hoechst Wax PED121, Hoechst Wax PED153, Hoechst Wax PED521, Hoechst Wax PED522, Hoechst Wax Ceridust 3620, Hoechst Wax Ceridust VP130, Hoechst Wax Ceridust VP5905, Hoechst Wax Ceridust VP9615A, Hoechst Wax Ceridust TM9610F, Hoechst Wax Ceridust 3715 (manufactured by Hoechst A.G.), MITSUI HI-WAX 420M (manufactured by Mitsui Petrochemical Industries, Ltd.), SANWAX E-300 and SANWAX E-250P (manufactured by Sanyo Chemical Industries Co., Ltd.), non-oxidation type polypropylene waxes, e.g., Hoechst Wachs PP230 (manufactured by Hoechst A.G.), and VISCOL 330-P, VISCOL 550-P, VISCOL 660-P (manufactured by Sanyo Chemical Industries Co., Ltd.), and oxidation type polypropylene waxes, e.g., VISCOL TS-200 (manufactured by Sanyo Chemical Industries Co., Ltd.).

As the examples of fatty acid metal salts (metal soaps), e.g., zinc stearate, calcium stearate, magnesium stearate, zinc oleate, zinc palmitate and magnesium palmitate are preferably used.

These mold releasing agents may be used alone or a plurality of compounds may be used in combination. Mold releasing agents having a low softening point (melting point), e.g., from 40 to 130° C., preferably from 50 to 120° C., are preferably used. A softening point is represented by an endothermic main peak value on the DSC endothermic curve measured with "DSC120" (a product of Seiko Instruments Inc.).

[Dispersants]:

Metal soaps and polyethylene glycol and the like are used as the dispersant.

[Charge Controlling Agents]:

A charge controlling agent is used for controlling the electrification property of toner mother particles, according to necessity. When the degree of a negative electrification property of a binder resin itself is low or when a binder resin itself is positively electrified, a negative charge controlling agent is used, so that the toner mother particles at large have a desired level of a negative electrification property.

As negative charge controlling agents, metal salts or metal complexes of salicylic acid derivatives, metal salts of benzilic acid derivatives, and phenyl borate quaternary ammonium salts are exemplified. As the metal salts of salicylic acid derivatives or benzilic acid derivatives, zinc salts, nickel salts, copper salts and chromium salts of these derivatives are preferably used.

The examples of commercially available negative charge controlling agents include, e.g., Oil Black (Color Index 26150), Oil Black BY (manufactured by Orient Chemical Industry Co., Ltd.), Bontron S-22 (manufactured by Orient Chemical Industry Co., Ltd.), salicylic acid metal complex E-81 (manufactured by Orient Chemical Industry Co., Ltd.), thioindigo series pigments, sulfonylamine derivatives of copper phthalocyanine, Spiron Black TRH (manufactured by HODOGAYA CHEMICAL Co., Ltd.), Bontoron S-34 (manufactured by Orient Chemical Industry Co., Ltd.), Nigrosine SO (manufactured by Orient Chemical Industry Co., Ltd.), Celesschwarz (R)G (manufactured by Farbenfabriken Bayer A.G.), Chromogeneschwarz ETOO (C.I. No. 14645), and Azo Oil Black (R) (manufactured by National Aniline Co.). Of these products, salicylic acid metal complex E-81 is preferably used. These negative charge controlling agents can be used alone or a plurality of compounds may be used in combination.

A negative charge controlling agent is preferably blended with a binder resin so that the quantity of electrification of toner mother particles becomes from −5 to −60 μC/g. Accordingly, the addition amount of a negative charge controlling agent is decided by the binder resin used, but generally the amount is from 0.1 to 5 parts by weight to 100 parts by weight of the binder resin.

A positive charge controlling agent is internally added to a negative electrifiable resin for the purpose of adjusting the quantity of negative electrification of toner mother particles, if necessary. As the positive charge controlling agents, commercially available products are used. For example, Nigrosine Base EX (manufactured by Orient Chemical Industry Co., Ltd.), a quaternary ammonium salt P-51 (manufactured by Orient Chemical Industry Co., Ltd.), Nigrosine Bontoron N-01 (manufactured by Orient Chemical Industry Co., Ltd.), Sudan Chief Schwarz BB (Solvent Black 3: Color Index 26150), Fetschwarz HBN (C.I. No. 26150), Brilliant Spirits Schwarz TN (manufactured by Farbenfabriken Bayer A.G.), and Zaponschwarz X (manufactured by Farberke Hoechst A.G.) are exemplified. Of these products, a quaternary ammonium salt P-51 is preferably used. In addition to the above products, alkoxylated amine, alkylamide and chelate pigments of molybdic acids are also used as a positive charge controlling agent. These positive charge controlling agents may be used alone or a plurality of compounds may be used in combination.

[Magnetic Agents]:

As magnetic agents, metallic powders of, e.g., Fe, Co, Ni, Cr, Mn and Zn, metallic oxides, e.g., $Fe_3O_4$, $Fe_2O_3$, $Cr_2O_3$, ferrite, and alloys showing ferromagnetism by thermal treatment, e.g., alloys containing manganese and acid, are exemplified. These magnetic agents may be subjected to treatment in advance with a coupling agent.

(i-2) Manufacture of Toner Mother Particles:

Toner mother particles are manufactured by adding a colorant and, if necessary, internal additives, e.g., a mold releasing agent, a dispersant, a charge controlling agent, and a magnetic agent, to a binder resin. A method of manufacturing mother particles by a pulverizing method including kneading, pulverization and classification processes is described below. Firstly, a binding agent, a colorant and additives, e.g., a mold releasing agent, in predetermined amounts are introduced into a mixer, e.g., Henschel Mixer FM 20B (a product of MITSUI MINING COMPANY, LIMITED) and blended homogeneously. The blending ratios of additives, e.g., a binder resin, a colorant, a charge controlling agent, and a mold releasing agent, are decided arbitrarily taking the color and electrification property of the toner into consideration. That is, internal additives are added by considering the electrification property of the toner in a manner such that a negative charge controlling agent is added to a positively electrifiable binder resin, a negative charge controlling agent is further added when the electrification property of a negatively electrifiable resin is not sufficient, or a binder resin itself is made negatively electrifiable resin. Particularly when a negatively electrifiable resin is used as a binder resin, it is preferred to adjust the quantity of electrification of toner mother particles to −5 to −60 μC/g as described later.

The above mixture is then introduced into a twin-screw kneading extruder (PCM-30, manufactured by IKEGAI KASEI CO., LTD) and homogeneously melt kneaded. As the melt-kneading means besides the above, continuous kneaders, e.g., "TEM-37" (manufactured by TOSHIBA MACHINE CO., LTD.) and "KRC Kneader" (manufactured by KURIMOTO, LTD.), and batch type kneaders, e.g., a hot-pressing kneader, are exemplified. Toner mother particles having a desired average particle size can be obtained by pulverizing the obtained melt-kneaded product by means of a grinding means. Pulverization is performed by, e.g., impinging pulverization by jet air using a jet pulverizer 200AFG (a product of HOSOKAWA MICRON CORPORATION) or IDS-2 (a product of Nippon Pneumatic Mfg Co., Ltd.), in addition, by a mechanical pulverizer Turbo Mill (a product of Kawasaki Heavy Industries, Ltd.) or Super Rotor (a product of Nisshin Engineering), etc.

In the next place, the particle size of the obtained toner mother particles is adjusted by wind power or rotation of rotors. For instance, a sharp particle size distribution can be obtained by using, e.g., a wind power classifier 100ATP (a product of HOSOKAWA MICRON CORPORATION), DSX-2 (a product of Nippon Pneumatic Mfg Co., Ltd.), or Elbow-Jet (a product of NITTETSU MINING CO., LTD.).

Toner mother particles may also be manufactured by a method of dissolving internal additives constituting the toner mother particles, e.g., a resin and a colorant, in an organic solvent, and then dispersing and granulating by the aqueous solvent with a classifying agent and an emulsifying agent, and then separating and drying the emulsion.

The quantity of electrification of toner mother particles is preferably from −5 to −60 μC/g. When the quantity of electrification is smaller than this range, the leakage of the toner from the developing chamber becomes conspicuous, while when the quantity is greater than −60 μC/g, there arises a new problem that excess development bias must be given to obtain sufficient image density.

For instance, the quantity of electrification of toner mother particles is measured as follows. Under the environment at 25° C., 45% RH, 0.03 g of toner mother particles and 0.97 g of a ferrite carrier are mixed in a polyethylene vessel having a capacity of 20 ml and stirred for 15 minutes at 100 rpm, to thereby electrify the toner mother particles. Subsequently, 0.3 g of the mixture is taken out, and nitrogen gas of the pressure of 0.3 kg/cm$^2$ is blown to the mixture of the toner mother particles and the carrier, to thereby separate the toner mother particles and the ferrite carrier. After that, the quantity of electrification of every toner (Q/m) is measured and the quantity of electrification of toner mother particles is computed from that. The measurement of the quantity of electrification is performed with, e.g., E-SPART Analyzer (a product of HOSOKAWA MICRON CORPORATION).

(ii) Negatively Electrifiable Silica Fine Particles:

Negatively electrifiable silica fine particles which are used in the present invention are not particularly restricted. Negatively electrifiable silica fine particles having an average particle size of from 4 to 120 nm, preferably from 5 to 50 nm, more preferably from 6 to 40 nm, the most preferably from 10 to 40 nm, are generally used. The smaller the average particle size of negatively electrifiable silica fine particles, the higher is the flowability of the toner obtained. When the average particle size is smaller than 4 nm, the negatively electrifiable silica fine particles are liable to be buried in the toner mother particles. When the average particle size is larger than 120 nm, there is the possibility of conspicuous degradation of the flowability. In the specification of the invention, the terminology "average particle size" of the fine particles of negatively electrifiable silica, positively electrifiable silica, toner mother particles and toner particles means a volume average particle size, unless otherwise indicated.

Negatively electrifiable silica fine particles having a uniform average particle size may be used alone, but it is preferred to use two or more negatively electrifiable silica fine particles respectively having different average particle sizes in combination. In general, negatively electrifiable silica fine particles having a small average particle size (small particle size silica) are used, but when negatively electrifiable silica fine particles having a large average particle size (large particle size silica) are used in combination with small particle size silica, not only the absolute value of the quantity of electrification can be made great, but small particle size silica can be prevented from being buried in toner mother particles due to the resistance of large particle size silica, as compared with the case where small particle size silica is used alone, so that the stability of electrification of the toner can be ensured for a long period of time. Further, it becomes possible to improve the flowability of the toner, and improve the storage stability of the toner by the blocking effect against heat. It is preferred to use negatively electrifiable silica fine particles having an average particle size of from 5 to 20 nm, preferably from 6 to 15 nm, as the small particle size silica and negatively electrifiable silica fine particles having an average particle size of from 20 to 50 nm, preferably from 20 to 40 nm, as the large particle size silica. In addition, the difference in average particle size between large particle size silica and small particle size silica is preferably 10 nm or more, and more preferably 20 nm or more.

For the purpose of imparting flowability to a toner and ensuring the stability of electrification for a long period of time, the addition ratio of large particle size silica to small particle size silica in a weight ratio is from 1/3 to 3/1, preferably from 1/2 to 2/1, and more preferably from 1/1.5 to 1.5/1.

When large particle size silica and small particle size silica are used together, two kinds of silica particles may be blended at the same time, alternatively either silica particles may be added prior to the other in the manufacture of a toner as described later.

The addition amount of negatively electrifiable silica fine particles is variable according to the particle size distribution or flowability of toner mother particles, the particle size distribution of external additives, and a desired quantity of electrification. For instance, the above small particle size silica is added in an amount of from 0.5 to 2.0 parts by weight, and preferably from 0.7 to 1.5 parts by weight to 100 parts by weight of the toner mother particles. In the case of large particle size silica, the addition amount is from 0.2 to 2.0 parts by weight, and preferably from 0.3 to 1.5 parts by weight to 100 parts by weight of the toner mother particles. When large particle size silica and small particle size silica are used in combination, they are added in total amount of from 0.5 to 3.0 parts by weight, preferably from 0.7 to 2.5 parts by weight to 100 parts by weight of the toner mother particles, taking the above-described blending ratio into consideration.

It is preferred that negatively electrifiable silica fine particles be subjected to hydrophobitization treatment. By making the surfaces of negatively electrifiable silica fine particles hydrophobic, the flowability and electrification property of the toner are further improved. The hydrophobitization treatment of silica fine particles is carried out according to wet methods or dry methods usually used in the industry with a silane compound, e.g., aminosilane, hexmethyldisilazane, or dimethyldicyclosilane; or a silicone oil, e.g., dimethylsilicone, methylphenylsilicone, fluorine-modified silicone oil, alkyl-modified silicone oil, amino-modified silicone oil, or epoxy-modified silicone oil.

As negatively electrifiable hydrophobic silica fine particles, commercially available RX200 and RX50 (manufactured by Nippon Aerosil Co., Ltd.) and TG811F, TG810G and TG308F (manufactured by Cabot) are used.

(iii) Positively Electrifiable Silica Fine Particles:

Positively electrifiable silica fine particles which are used in the present invention are not especially limited. The volume average particle size of positively electrifiable silica fine particles is preferably from 10 to 50 nm, more preferably from 15 to 40 nm, taking the flowability and the like into consideration.

In manufacturing a toner as described later, positively electrifiable silica fine particles are added in an amount of from 0.1 to 1.0 part by weight, preferably from 0.2 to 0.8 parts by weight to 100 parts by weight of the toner mother particles.

When a negatively electrifiable resin is used as the binder resin and negatively electrifiable silica fine particles are not used as the charge controlling agent, positively electrifiable silica fine particles are added in an amount of from 0.1 to 2.0 parts by weight, preferably from 0.3 to 1.5 parts by weight to 100 parts by weight of the toner mother particles.

It is preferred that positively electrifiable silica fine particles be subjected to hydrophobitization treatment. By making the surfaces of positively electrifiable silica fine particles hydrophobic, the fluctuation of the electrification property of the toner due to the changes in external environment can be lessened (that is, a stable electrification property can be maintained), and the flowability of the toner can be improved. The hydrophobitization of positively electrifiable silica fine particles is carried out according to the same method as the hydrophobitization of negatively electrifiable silica fine particles.

As positively electrifiable hydrophobic silica fine particles, commercially available NA50H (manufactured by Nippon Aerosil Co., Ltd.) and TG820F (manufactured by Cabot) are used.

(iv) Titanium Oxide (Titania) Fine Particles:

Titanium oxide fine particles for use in the present invention are not particularly limited. Titanium oxide fine particles having a relatively small electrical resistivity are preferably used. Titanium oxide may take a crystal form of rutile type, anatase type, rutile-anatase type. Titanium oxide of any crystal form may be used, but titanium oxide of a rutile-anatase type is preferably used for the reason that the adjustment of electric charge is easy and a rutile-anatase type titanium oxide is difficult to be buried in toner mother particles even when the number of sheets of printing increases.

The size of titanium oxide fine particles is not particularly restricted but it is preferred that the particle size or long axis length be 10 to 30 nm. In the case of a rutile-anatase type titanium oxide, titanium oxide fine particles having a long axis length of from 10 to 30 nm or so, preferably 20 nm or so, are preferred.

Titanium oxide fine particles are used in an amount of from 0.2 to 2.0 parts by weight, preferably from 0.3 to 1.5 parts by weight to 100 parts by weight of the toner mother particles. The weight ratio of titanium oxide fine particles to positively electrifiable silica fine particles is preferably from 1/3 to 3/1 from the point of capable of adjusting electric charge without causing extreme reduction of electrical resistance of the toner.

By making the surfaces of titanium oxide fine particles hydrophobic, the fluctuation of the electrification property of the toner due to the changes in external environment can be lessened (that is, a stable electrification property can be maintained), and the flowability of the toner can be improved. The hydrophobitization of titanium oxide fine particles is carried out according to the same method as the hydrophobitization of negatively electrifiable silica fine particles.

As hydrophobic titanium oxide fine particles, STT-30S (manufactured by TITAN KOGYO KABUSHIKI KAISHA) and the like are used.

(v) Long Chain Fatty Acid or Salt Thereof

The long chain fatty acids or salts thereof for use in the present invention are not particularly restricted. As the long chain fatty acids, long chain fatty acids preferably having from 10 to 30 carbon atoms, more preferably from 12 to 28, and most preferably from 12 to 18, are used. As the long chain fatty acids, long chain saturated fatty acids and long chain unsaturated fatty acids are exemplified. Long chain saturated fatty acids are preferably used. The long chain fatty acids may be branched, but long chain saturated fatty acids, e.g., stearic acid, is preferably used.

It is preferred to use the long chain fatty acids in the form of salts, and more preferably in the form of metal salts (so-called metal soaps). The metal salts of the long chain fatty acids are not particularly restricted and, e.g., calcium salts, zinc salts, magnesium salts, aluminum salts and lithium salts are exemplified. As the metal soaps, e.g., magnesium stearate, calcium stearate and zinc stearate are exemplified, and fine particles of these metal soaps are preferably used. Particles comprising long chain saturated fatty acids or salts thereof may be used alone or as mixtures of two or more kinds.

Long chain fatty acids or salts thereof, particularly long chain fatty acid metal salts (metal soaps) have a volume average particle size or long axis size of preferably from 0.5 to 10 μm, more preferably from 1 to 5 μm. When the volume average particle size or long axis size deviates from this range, the long chain fatty acids or salts thereof cannot show the effects as the binder, lubricant and auxiliary flowing agent, or the coagulation of the toner cannot be sufficiently inhibited.

It is preferred for the long chain fatty acids or salts thereof, particularly metal soaps to have a melting point of from 100 to 150° C. or so in view of heat resistance and lubricating ability. When the melting point is lower than 100° C., the heat resistance of the toner lowers, and there is the possibility of the coagulation of the toner when stored under the high temperature environment. When the melting point is higher than 150° C., the lubricating function of the toner is liable to decrease.

As metal soaps, metal soaps manufactured by a direct method and metal soaps manufactured by a double decomposition method are known, and it is preferred to use metal soaps manufactured by a direct method containing less impurities by pulverizing and adjusting the particle sizes so as to reach the above average particle size.

The addition amount of the long chain fatty acids or salts thereof, particularly particles comprising long chain saturated fatty acids or salts thereof, is from 0.1 to 1.0 part by weight, preferably from 0.1 to 0.5 parts by weight to 100 parts by weight of the toner mother particles. When the addition amount is less than 0.1 parts by weight, the effect as the binder cannot be exhibited, coagulation of the toner cannot be prevented, and the effects as auxiliary flowing agent and lubricant cannot be sufficiently shown. When the addition amount is higher than 1.0 part by weight, the flowability reduces, start-up of electrification conspicuously deteriorates, so that there is the possibility of generation of noise such as fog.

(vi) Inorganic Fine Particles

Inorganic fine particles other than titanium oxide fine particles are also externally added for the purpose of controlling the electrification property and improving flowability. For instance, as inorganic fine particles, fine particles of metallic oxide, e.g., aluminum oxide, strontium oxide, tin oxide, zirconia oxide, magnesium oxide, and indium oxide; fine particles of nitrides, e.g., silicon nitride; fine particles of carbides, e.g., silicon carbide; fine particles of metal salts, e.g., calcium sulfate, barium sulfate and calcium carbonate; and inorganic fine particles of these are exemplified. Fine particles of metallic oxides having a relatively small electrical resistivity, e.g., $10^9 \Omega \cdot cm$ or less are preferably used.

The sizes of inorganic fine particles added are not particularly restricted, but the sizes of from 10 to 30 nm are preferred. It is preferred that the surfaces of these inorganic fine particles be subjected to hydrophobitization treatment for the purpose of improving the stabilization of electrification characteristics. The hydrophobitization treatment of inorganic fine particles is performed by the same method as used in the hydrophobitization treatment of negatively electrifiable silica fine particles or positively electrifiable silica fine particles.

(II) Toner of the First Invention and Manufacturing Method Thereof:

In the first invention, three kinds of toners (toner 1A, toner 1B and toner 1C) are obtained by specifying the addition order of additives.

[Toner 1A]:

Toner 1A can be obtained by a process comprising, in the following order (II-1) a step of externally adding negatively electrifiable silica fine particles to toner mother particles containing a binder resin and a colorant; (II-2) a step of externally adding titanium oxide fine particles, and (II-3) a step of externally adding positively electrifiable silica fine particles.

A method of manufacturing the toner of the first invention is described in further detail below. In step (II-1), negatively electrifiable silica fine particles are externally added to toner mother particles containing a binder resin and a colorant. In step (II-1), negatively electrifiable silica fine particles having a uniform average particle size may be used alone, but it is preferred to use two or more negatively electrifiable silica fine particles respectively having different average particle sizes in combination. In general, negatively electrifiable silica fine particles having a small average particle size (small particle size silica) are used, but when negatively electrifiable silica fine particles having a large average particle size (large particle size silica) are used in combination with small particle size silica, not only the absolute value of the quantity of electrification can be made great, but small particle size silica can be prevented from being buried in toner mother particles due to the resistance of large particle size silica, as compared with the case where small particle size silica is used alone, so that the stability of electrification of the toner can be ensured for a long period of time. Further, it becomes possible to improve the flowability of the toner, and improve the storage stability of the toner by the blocking effect against heat. It is preferred to use negatively electrifiable silica fine particles having an average particle size of from 5 to 20 nm, preferably from 10 to 15 nm, as the small particle size silica and negatively electrifiable silica fine particles having an average particle size of from 20 to 50 nm, preferably from 20 to 40 nm, as the large particle size silica. In addition, the difference in average particle size between large particle size silica and small particle size silica is preferably 10 nm or more, and more preferably 20 nm or more.

For the purpose of imparting flowability to a toner and ensuring the stability of electrification for a long period of time, the addition ratio of large particle size silica to small particle size silica in a weight ratio is from 1/3 to 3/1, preferably from 1/2 to 2/1, and more preferably from 1/1.5 to 1.5/1.

Large particle size silica and small particle size silica may be blended at the same time, alternatively either silica particles may be added prior to the other.

In the next place, titanium oxide fine particles are externally added (step (II-2)), and then positively electrifiable silica fine particles are externally added (step (II-3)). It is preferred that the surfaces of titanium oxide fine particles and positively electrifiable silica fine particles should be subjected to hydrophobitization treatment. By making the surfaces of titanium oxide fine particles and positively electrifiable silica fine particles hydrophobic, the flowability of the toner can be improved.

The addition amounts of negatively electrifiable silica fine particles, titanium oxide fine particles and positively electrifiable silica fine particles which are used in the manufacture of toner 1A in the first invention are variable according to the particle size distribution or flowability of toner mother particles, or the particle size distribution of external additives, and a desired quantity of electrification. In the case of negatively electrifiable silica fine particles, e.g., the above small particle size silica is added in an amount of from 0.5 to 2.0 parts by weight, and preferably 0.7 to 1.5 parts by weight to 100 parts by weight of the toner mother particles. In the case of large particle size silica, the addition amount is from 0.5 to 2.0 parts by weight, and preferably from 0.6 to 1.5 parts by weight to 100 parts by weight of the toner mother particles. When large particle size silica and small particle size silica are used in combination, they are added in total amount of from 0.5 to 2.5 parts by weight, and preferably from 0.7 to 2.0 parts by weight to 100 parts by weight of the toner mother particles, taking the above-described blending ratio into consideration.

Titanium oxide fine particles are added in an amount of from 0.2 to 2.0 parts by weight to 100 parts by weight of the toner mother particles, and preferably from 0.3 to 1.5 parts by weight.

Positively electrifiable silica fine particles are added in an amount of from 0.1 to 1.0 parts by weight to 100 parts by weight of the toner mother particles, and preferably from 0.2 to 0.8 parts by weight.

It is preferred that titanium oxide fine particles and positively electrifiable silica fine particles be externally added in a weight ratio of 1/3 to 3/1 from the point that the electric charge can be adjusted without bringing about an extreme reduction of electric resistance of the toner.

If necessary, (vi) inorganic fine particles may be added for the purpose of the adjustment of electric charge and the improvement of flowability. The inorganic fine particles may be added before or after step (II-2) and step (II-3), or during step (II-2) or step (II-3), provided that they are added after the external addition of negatively electrifiable silica fine particles (step (II-1)). It is preferred to add inorganic fine particles with the addition of titanium oxide fine particles in step (II-2) from the viewpoint of the stabilization of the electrification property at the same stage.

External addition of negatively electrifiable silica fine particles, titanium oxide fine particles, and positively electrifiable silica fine particles to toner mother particles is carried out by machines or methods usually used in this industry, e.g., high speed fluid mixers, such as a Henschel mixer or Perpenmyer, and mixers using a mechanochemical method. Toner 1A can be obtained, for example, by putting toner mother particles and negatively electrifiable silica fine particles into a Henschel mixer and stirring at a predetermined stirring velocity for predetermined time, introducing titanium oxide fine particles and further stirring at a predetermined stirring velocity for predetermined time, and finally introducing positively electrifiable silica fine particles and stirring at a predetermined stirring velocity for predetermined time. The velocity and time of stirring in each step can be set independently, but the conditions may be the same.

According to the manufacturing method of toner 1A of the first invention, since the static attraction between toner mother particles and negatively electrifiable silica fine particles is not hindered by adding negatively electrifiable silica fine particles alone in the first place in step (II-1), and the difference between the work function of negatively electrifiable silica fine particles and the work function of toner mother particles is large, negatively electrifiable silica fine particles can be strongly adhered to toner mother particles. Therefore, the desorption of negatively electrifiable silica fine particles is prevented and the fluctuation of electrification property lessens, as a result, an electrification property can be stabilized for a long period of time.

In step (II-2), as compared with the case where titanium oxide fine particles are added with negatively electrifiable silica fine particles or positively electrifiable silica fine particles at the same stage, from the relationship between the work function of titanium oxide fine particles and the work function of mother particles having been externally added therein negatively electrifiable silica fine particles, the isolation of titanium oxide fine particles can be restrained.

Titanium oxide fine particles have low electrical resistance, accordingly there is high possibility that the electric charge is excessively lost when titanium oxide fine particles are present on the surface of the toner. On the other hand, positively electrifiable silica fine particles are negatively charged and have a high electrical resistance value. Therefore, by externally adding positively electrifiable silica fine particles in step (II-3) after titanium oxide fine particles have been added, the positively electrifiable silica fine particles function as the electric charge adjuster and the reduction of the electric resistivity of the toner is restrained, thereby the electric charge is unified. Further, since negatively charged toner particles come to be liberated and present in the toner in an appropriate rate, the flowability of the toner becomes good and, at the same time, the liberated negatively charged toner particles function as the carrier, so that the electrification property becomes more uniform.

On the other hand, conventional toners, e.g., the toners disclosed in patent documents 1 to 4, are toners obtained by externally adding positively electrifiable silica fine particles and negatively electrifiable silica fine particles at the same time, and it is thought that by adding positively electrifiable silica fine particles and negatively electrifiable silica fine particles at the same time, the static attraction between the toner mother particles and the negatively electrifiable silica fine particles becomes small, and the desorption of the negatively electrifiable silica fine particles are liable to occur.

As described above, as compared with conventional toners obtained by the simultaneous mixture, the toner of the first invention has a uniform electrification property, and has excellent effects such that a uniform electrification property and excellent flowability are stably maintained for a long period of time by restraining the isolation of negatively electrifiable and/or positively electrifiable silica fine particles or titanium oxide fine particles.

[Toner 1B]:

Toner 1B can be obtained by a process comprising, in the following order (II-1) a step of externally adding negatively electrifiable silica fine particles to toner mother particles containing a binder resin and a colorant, (II-2) a step of externally adding titanium oxide fine particles, (II-3) a step of externally adding positively electrifiable silica fine particles, and (II-4) a step of externally adding particles comprising a long chain fatty acid or a salt thereof. Steps (II-1) to (II-3) in the manufacturing process of toner 1B are in common with steps (II-1) to (II-3) in the manufacturing process of toner 1A, and materials and external addition methods used in these steps are also in common with those in the case of toner 1A. Further, the fact that external addition of large particle size silica and small particle size silica as mixture in the above specific range is preferred is also in common with the case of the manufacture of toner 1A. Toner 1B can be obtained by performing (II-4) a step of externally adding particles comprising a long chain fatty acid or a salt thereof after step (II-3). By further externally adding particles comprising a long chain fatty acid or a salt thereof after step (II-3), the liberation of positively electrifiable silica fine particles and titanium oxide fine particles can be restrained, and the stability of electrification is further improved.

As described above, particles comprising a long chain fatty acid or a salt thereof can restrain the isolation of positively electrifiable silica fine particles and titanium oxide fine particles. This is probably because particles comprising a long chain fatty acid or a salt thereof function as the binding agent of positively electrifiable silica fine particles and titanium oxide fine particles, but it is also thought that particles comprising a long chain fatty acid or a salt thereof function as the coagulation inhibitor, auxiliary flowing agent and lubricant.

Particles comprising a long chain fatty acid or a salt thereof are added in an amount of from 0.1 to 1.0 part by weight to 100 parts by weight of toner mother particles, preferably from 0.1 to 0.5 part by weight. The method of external addition of particles comprising a long chain fatty acid or a salt thereof is not particularly limited and the external addition methods of toner 1A are applied.

The thus-obtained toner 1B has uniform electrification property as compared with toners obtained by conventional simultaneous blending methods, and this electrification property is stably maintained for a long period of time, and excellent flowability is maintained for a long period of time. As compared with toner 1A, toner 1B has excellent advantage such that the electrification property is further improved.

[Toner 1C]:

Toner 1C can be obtained by a process comprising, in the following order (II-1) a step of externally adding negatively electrifiable silica fine particles to toner mother particles containing a binder resin and a colorant, (II-2) a step of externally adding titanium oxide fine particles, and (II-3') a step of externally adding positively electrifiable silica fine particles, and particles comprising a long chain fatty acid or a salt thereof.

Steps (II-1) and (II-2) in the manufacturing process of toner 1C are in common with steps (II-1) and (II-2) in the manufacturing process of toner 1A and toner 1B. However, toner 1C is different from toner 1A and toner 1B in the point: in toner 1A, only positively electrifiable silica fine particles are added in step (II-3), in toner 1B, positively electrifiable silica fine particles are added in step (II-3) and particles comprising a long chain fatty acid or a salt thereof are added separately in step (II-4) in this order. Contrary to this, in toner 1C, positively electrifiable silica fine particles and particles comprising a long chain fatty acid or a salt thereof are added in step (II-3') at the same stage.

Toner 1C obtained by steps (II-1) to (II-3') has various advantages including the effects of step (II-1) that the desorption of negatively electrifiable silica fine particles can be prevented, the fluctuation of electrification property lessens, and the electrification property can be maintained stably for a long period of time, the effect of step (II-2) that the isolation of titanium oxide fine particles can be restrained from the relationship with the work function of mother particles having added thereto negatively electrifiable silica fine particles, in addition, the effect of step (II-3') that the isolation of silica fine particles and titanium oxide fine particles can further be inhibited, and electrification can be further stabilized.

In externally adding negatively electrifiable silica fine particles in step (II-1), that the external addition of large particle size silica and small particle size silica as mixture in the above specific range is preferred is the same as in the case of toner 1A. Further, the addition amounts of negatively electrifiable silica fine particles, positively electrifiable silica fine particles, and titanium oxide fine particles in toner 1C, and the external addition methods of these external additives are the same as those in the case of toner 1A. Further, when inorganic fine particles are added according to necessity, it is preferred that the inorganic fine particles are added at the same stage with the external addition of titanium oxide fine particles in step (II-2), or between step (II-2) and step (II-3').

(III) Toner of the Second Invention and Manufacturing Method Thereof:

The toner in the second invention is obtained by a process comprising, in the following order (III-1) a step of externally adding negatively electrifiable silica fine particles to toner mother particles containing a binder resin and a colorant; and (III-2) a step of externally adding titanium oxide fine particles, positively electrifiable silica fine particles, and particles comprising a long chain fatty acid or a salt thereof at the same time.

A method of manufacturing the toner of the second invention is described in further detail below. In step (III-1), negatively electrifiable silica fine particles are externally added to toner mother particles containing a binder resin and a colorant. In step (III-1), negatively electrifiable silica fine particles having a uniform average particle size may be used alone, but it is preferred to use two or more negatively electrifiable silica fine particles respectively having different average particle sizes in combination. In general, negatively electrifiable silica fine particles having a small average particle size (small particle size silica) are used, but when negatively electrifiable silica fine particles having a large average particle size (large particle size silica) are used in combination with small particle size silica, not only the absolute value of the quantity of electrification can be made great, but small particle size silica can be prevented from being buried in toner mother particles due to the resistance of large particle size silica, as compared with the case where small particle size silica is used alone, so that the stability of electrification of the toner can be ensured for a long period of time. Further, it becomes possible to improve the flowability of the toner, and improve the storage stability of the toner by the blocking effect against heat. It is preferred to use negatively electrifiable silica fine particles having an average particle size of from 5 to 20 nm, preferably from 6 to 15 nm, as the small particle size silica and negatively electrifiable silica fine particles having an average particle size of from 20 to 50 nm, preferably from 20 to 40 nm, as the large particle size silica. In addition, the difference in average particle size between large particle size silica and small particle size silica is preferably 10 nm or more, and more preferably 20 nm or more.

For the purpose of imparting flowability to a toner and ensuring the stability of electrification for a long period of time, the addition ratio of large particle size silica to small particle size silica in a weight ratio is from 1/3 to 3/1, preferably from 1/2 to 2/1, and more preferably from 1/1.5 to 1.5/1.

Large particle size silica and small particle size silica may be blended at the same time, alternatively either silica particles may be added prior to the other.

In the next place, titanium oxide fine particles, positively electrifiable silica fine particles, and particles comprising a long chain fatty acid or a salt thereof are externally added at the same time to the toner mother particles obtained in step (III-1) to which negatively electrifiable silica fine particles were externally added (step (III-2)). It is preferred that the surfaces of titanium oxide fine particles and positively electrifiable silica fine particles should be subjected to hydrophobitization treatment. By making the surfaces of titanium oxide fine particles and positively electrifiable silica fine particles hydrophobic, the fluctuation of the electrification property of the toner due to the changes in external environment can be lessened, and the flowability of the toner can be improved.

The addition amounts of negatively electrifiable silica fine particles, titanium oxide fine particles and positively electrifiable silica fine particles which are used in the manufacture of a toner in the second invention are variable according to the particle size distribution or flowability of toner mother particles, or the particle size distribution of external additives, and a desired quantity of electrification. In the case of negatively electrifiable silica fine particles, e.g., the above small particle size silica is added in an amount of from 0.5 to 2.0 parts by weight to 100 parts by weight of the toner mother particles, and preferably 0.7 to 1.5 parts by weight. In the case of large particle size silica, the addition amount is from 0.2 to 2.0 parts by weight to 100 parts by weight of the toner mother particles, and preferably from 0.3 to 1.5 parts by weight. When large particle size silica and small particle size silica are used in combination, they are added in total amount of from 0.5 to 3 parts by weight to 100 parts by weight of the toner mother particles, and preferably from 0.7 to 2.5 parts by weight, taking the above-described blending ratio into consideration.

Positively electrifiable silica fine particles are added in an amount of from 0.1 to 1.0 parts by weight to 100 parts by weight of the toner mother particles, and preferably from 0.2 to.0.8 parts by weight.

Titanium oxide fine particles are added in an amount of from 0.2 to 2.0 parts by weight to 100 parts by weight of the toner mother particles, and preferably from 0.3 to 1.5 parts by weight.

It is preferred that titanium oxide fine particles and positively electrifiable silica fine particles be externally added in a weight ratio of 1/3 to 3/1 from the point that the electric charge can be adjusted without bringing about an extreme reduction of electric resistance of the toner.

Particles comprising a long chain fatty acid or a salt thereof are added in an amount of from 0.1 to 1.0 parts by weight to 100 parts by weight of the toner mother particles, and preferably from 0.1 to 0.5 parts by weight.

If necessary, (vi) inorganic fine particles may be added for the purpose of the adjustment of electric charge and the improvement of flowability. The inorganic fine particles may be added before or after step (III-2), provided that they are added after the external addition of negatively electrifiable silica fine particles (step (III-1)).

External addition of negatively electrifiable silica fine particles, positively electrifiable silica fine particles, titanium oxide fine particles and a long chain fatty acid or a salt thereof to toner mother particles is carried out by machines or methods usually used in this industry, e.g., high speed fluid mixers, such as a Henschel mixer or Perpenmyer, and mixers using a mechanochemical method. The toner of the second invention can be obtained, for example, by putting toner mother particles and negatively electrifiable silica fine particles into a Henschel mixer and stirring at a predetermined stirring velocity for predetermined time, and then introducing positively electrifiable silica fine particles, titanium oxide fine particles and a long chain fatty acid or a salt thereof, and further stirring at a predetermined stirring velocity for predetermined time. The velocity and time of stirring in each step can be set independently, but the conditions may be the same.

According to the manufacturing method of the toner of the second invention, since the static attraction between toner mother particles and negatively electrifiable silica fine particles is not hindered by adding negatively electrifiable silica fine particles alone in the first place in step (III-1), and the difference between the work function of negatively electrifiable silica fine particles and the work function of toner mother particles is large, negatively electrifiable silica fine particles can be strongly adhered to toner mother particles. Therefore, the desorption of negatively electrifiable silica fine particles is prevented and the fluctuation of electrification property lessens, as a result, an electrification property can be stabilized for a long period of time.

In the above step (III-2), by adding titanium oxide fine particles, positively electrifiable silica fine particles and a long chain fatty acid or a salt thereof at the same time, it becomes possible to adjust the surface electric charge of the toner by positively electrifiable silica fine particles and titanium oxide fine particles without extremely lowering the electric resistance of the toner. Titanium oxide fine particles have low electrical resistance, accordingly there is high possibility that the electric charge is excessively lost when titanium oxide fine particles are present on the surface of the toner. On the other hand, positively electrifiable silica fine particles are negatively charged and have a high electrical resistance value. Therefore, by externally adding titanium oxide fine particles and positively electrifiable silica fine particles at the same time, the surface electric charge of the toner is adjusted and unified without extremely lowering the electric resistivity of the toner. Further, since positively electrifiable silica fine particles come to be liberated and present in the toner in an appropriate rate, the flowability of the toner becomes good and, at the same time, the liberated positively electrifiable silica fine particles function as the carrier, so that the electrification property becomes more uniform.

In addition to the above effects, such an effect can also be obtained, that is, a long chain fatty acid or a salt thereof (in particular, a metal soap) functions as a binder and prevents the desorption of positively electrifiable silica fine particles and titanium oxide from which are electric charge adjustors from the surface of the toner. It is also thought that the long chain fatty acid or a salt thereof has the effect to prevent coagulation of the toner, and the function as the auxiliary flowing agent and lubricant.

On the other hand, conventional toners, e.g., the toners disclosed in patent documents 1 to 4, are toners obtained by externally adding positively electrifiable silica fine particles and negatively electrifiable silica fine particles at the same time, and it is thought that by adding positively electrifiable silica fine particles and negatively electrifiable silica fine particles at the same time, the static attraction between the toner mother particles and the negatively electrifiable silica fine particles becomes small, and the desorption of the negatively electrifiable silica fine particles are liable to occur.

As described above, as compared with conventional toners obtained by the simultaneous mixture, the toner of the second invention has a uniform electrification property, and has excellent effects such that a uniform electrification property and excellent flowability are stably maintained for a long period of time by restraining the isolation of negatively electrifiable and/or positively electrifiable silica fine particles or titanium oxide fine particles.

(IV) Toner of the Third Invention and Manufacturing Method Thereof:

The toner in the third invention is obtained by a process comprising, in the following order (IV-1) a step of externally adding negatively electrifiable silica fine particles to toner mother particles containing a binder resin and a colorant; and (IV-2) a step of externally adding positively electrifiable silica fine particles.

A method of manufacturing the toner of the third invention is described in further detail below. In step (IV-1), negatively electrifiable silica fine particles are externally added to toner mother particles containing a binder resin and a colorant. In step (IV-1), negatively electrifiable silica fine particles having a uniform average particle size may be used alone, but it is preferred to use two or more negatively electrifiable silica fine particles respectively having different average particle sizes in combination. In general, negatively electrifiable silica fine particles having a small average particle size (small particle size silica) are used, but when negatively electrifiable silica fine particles having a large average particle size (large particle size silica) are used in combination with small particle size silica, not only the absolute value of the quantity of electrification can be made great, but small particle size silica can be prevented from being buried in toner mother particles due to the resistance of large particle size silica, as compared with the case where small particle size silica is used alone, so that the stability of electrification of the toner can be ensured for a long period of time. Further, it becomes possible to improve the flowability of the toner, and improve the storage stability of the toner by the blocking effect against heat. It is preferred to use negatively electrifiable silica fine particles having an average particle size of from 5 to 20 nm, preferably from 6 to 15 nm, as the small particle size silica and negatively electrifiable silica fine particles having an average particle size of from 20 to 50 nm, preferably from 20 to 40 nm, as the large particle size silica. In addition, the difference in average particle size between large particle size silica and small particle size silica is preferably 10 nm or more, and more preferably 20 nm or more.

For the purpose of imparting flowability to a toner and ensuring the stability of electrification for a long period of time, the addition ratio of large particle size silica to small particle size silica in a weight ratio is from 1/3 to 3/1, preferably from 1/2 to 2/1, and more preferably from 1/1.5 to 1.5/1.

Large particle size silica and small particle size silica may be blended at the same time, alternatively either silica particles may be added prior to the other.

In the next place, positively electrifiable silica fine particles are externally added (step (IV-2)). It is preferred that the surfaces of positively electrifiable silica fine particles be subjected to hydrophobitization treatment. By making the surfaces of positively electrifiable silica fine particles hydrophobic, the fluctuation of the electrification property of the toner due to the changes in external environment can be lessened, and the flowability of the toner can be improved.

The addition amounts of negatively electrifiable silica fine particles and positively electrifiable silica fine particles used in the manufacture of a toner are not necessarily limited to the above weight ratio, since there is a case where the external addition amounts to be stuck around toner mother particles are adjusted according to the average particle size or the particle size distribution of toner mother particles.

In the case of negatively electrifiable silica fine particles, e.g., the above small particle size silica is added in an amount of from 0.5 to 4.0 parts by weight to 100 parts by weight of the toner mother particles, and preferably from 0.5 to 2 parts by weight, and more preferably from 0.7 to 1.5 parts by weight. In the case of large particle size silica, the addition amount is from 0.2 to 2.0 parts by weight to 100 parts by weight of the toner mother particles, and preferably from 0.3 to 1.5 parts by weight. When large particle size silica and small particle size silica are used in combination, they are added in total amount of from 0.5 to 4 parts by weight to 100 parts by weight of the toner mother particles, preferably from 0.5 to 3 parts by weight, and more preferably from 0.7 to 2.5 parts by weight, taking the above-described blending ratio into consideration.

Positively electrifiable silica fine particles are added in an amount of from 0.1 to 1.0 parts by weight to 100 parts by weight of the toner mother particles, and preferably from 0.2 to 0.8 parts by weight.

In the third invention, the addition ratio of negatively electrifiable silica fine particles to positively electrifiable silica fine particles is not particularly restricted. However, considering the uniformity and stability of electrification of the toner obtained, the amount ratio of negatively electrifiable silica fine particles/positively electrifiable silica fine particles is preferably from 1/3 to 40/1, more preferably from 1/1 to 30/1, and still more preferably from 1/1 to 20/1. By adjusting the ratio of negatively electrifiable silica fine particles/positively electrifiable silica fine particles to this range, electric charge is adjusted, the isolation rate of silica is restrained, and the rate of occurring of negatively charged toner is controlled, thus the uniformity of electrification, long term electrification stability and good flowability of the toner are brought about.

On the other hand, when the ratio is smaller than 1/3, the influence of positively electrifiable silica becomes great, a negative electrification property cannot be adjusted well, the fluctuation of electric charge at use time with aging becomes great, and the electrification property cannot be maintained stably for a long period of time, and there is the possibility of the degradation of transfer efficiency. On the other hand, when the ratio is greater than 40/1, the uniformity of electrification of the toner is impaired, in addition, the isolation rate of silica fine particles becomes great. As a result, the fluctuation of electric charge at use time with aging becomes great and the electrification property cannot be maintained stably for a long period of time, and there is the possibility of the degradation of development efficiency and transfer efficiency.

Since the addition amounts of negatively electrifiable silica fine particles and positively electrifiable silica fine particles to toner mother particles are preferably respectively the above range, the ratio of negatively electrifiable silica fine particles/positively electrifiable silica fine particles may be decided in the preferred range of each addition amount.

If necessary, (iv) titanium oxide fine particles, (v) a long chain fatty acid or a salt thereof, and (vi) inorganic fine particles may be added for the purpose of the adjustment of electric charge and the improvement of flowability. The addition amounts of these external additives are selected so as not to hinder the characteristics of the toner of the third invention.

External addition of negatively electrifiable silica fine particles and positively electrifiable silica fine particles to toner mother particles is carried out by machines or methods usually used in this industry, e.g., high speed fluid mixers, such as a Henschel mixer or Perpenmyer, and mixers using a mechanochemical method. The toner of the third invention can be obtained, for example, by putting toner mother particles and negatively electrifiable silica fine particles into a Henschel mixer and stirring at a predetermined stirring velocity for predetermined time as the first stage step (step (IV-1)), and introducing positively electrifiable silica fine particles and stirring at a predetermined stirring velocity for predetermined time as the second stage step (step (IV-2)). The velocity and time of stirring in each step can be set independently, but the conditions may be the same. External additives added according to necessity are also added in the same manner.

According to the manufacturing method of the toner of the third invention, since the static attraction between toner mother particles and negatively electrifiable silica fine particles is not hindered by adding negatively electrifiable silica fine particles alone in the first place in step (IV-1), and the difference between the work function of negatively electrifiable silica fine particles and the work function of toner mother particles is large, negatively electrifiable silica fine particles can be strongly adhered to toner mother particles. Therefore, the desorption of negatively electrifiable silica fine particles is prevented and the fluctuation of electrification property lessens, as a result, an electrification property can be stabilized for a long period of time.

Subsequently, positively electrifiable silica fine particles are externally added in step (IV-2). Since the externally added positively electrifiable silica fine particles function as the electric charge adjuster, the electric charge per a toner is unified. Further, since the positively electrifiable silica fine particles come to be liberated and present in the toner in an appropriate rate, the flowability of the toner becomes good and, at the same time, the free positively electrifiable silica fine particles function as the carrier, so that the electrification property becomes more uniform.

As a result of synergistic function of each effect of step (IV-1) and step (IV-2), good electrification uniformity, long term electrification stability and good flowability are brought about to the toner of the third invention.

On the other hand, conventional toners, e.g., the toners disclosed in patent documents 1 to 4, are toners obtained by externally adding positively electrifiable silica fine particles and negatively electrifiable silica fine particles at the same time, and it is thought that by adding positively electrifiable silica fine particles and negatively electrifiable silica fine particles at the same time, the static attraction between the toner mother particles and the negatively electrifiable silica fine particles becomes small, as a result, strong adhesion is hindered and the desorption of the negatively electrifiable silica fine particles are liable to occur.

As described above, as compared with conventional toners obtained by the simultaneous mixture of positively electrifiable silica fine particles and negatively electrifiable silica fine particles, the toner of the third invention has a uniform electrification property, and has excellent effects such that a uniform electrification property and excellent flowability are stably maintained for a long period of time by restraining the isolation of negatively electrifiable and/or positively electrifiable silica fine particles.

(V) Toner of the Fourth Invention and Manufacturing Method Thereof:

The toner of the fourth invention can be obtained by externally adding positively electrifiable silica, titanium oxide and particles comprising a long chain fatty acid or a salt thereof to negatively electrifiable toner mother particles. Further, by specifying the addition order of these additives, two kinds of toners (Toner 4A and Toner 4B) are obtained. The quantity of electrification is generally adjusted so as to be from −7 to −30 μC/g.

[Toner 4A]:

Toner 4A can be obtained by adding positively electrifiable silica, titanium oxide and fatty acid or a metal salt thereof to negatively electrifiable toner mother particles, preferably toner mother particles having a quantity of electrification of from −5 to −60 μC/g. The addition amounts of positively electrifiable silica, titanium oxide fine particles, and fatty acid or a metal salt thereof which are used in the manufacture of Toner 4A are variable according to the particle size distribution or flowability of toner mother particles, the particle size distribution of external additives, and a desired quantity of electrification.

Positively electrifiable silica fine particles are added in an amount of from 0.1 to 2.0 parts by weight to 100 parts by weight of the toner mother particles, and preferably from 0.3 to 1.5 parts by weight.

Titanium oxide fine particles are added in an amount of from 0.2 to 2.0 parts by weight to 100 parts by weight of the toner mother particles, and preferably from 0.3 to 1.5 parts by weight.

The positively electrifiable silica fine particles and the titanium oxide fine particles are preferably added in a weight ratio of from 1/3 to 3/1 for capable of adjusting electric charge without causing extreme reduction of the electrical resistance of the toner.

The particles comprising a long chain fatty acid or a salt thereof are added in an amount of from 0.1 to 1.0 part by weight to 100 parts by weight of the toner mother particles, and preferably from 0.1 to 0.5 parts by weight.

Further, if necessary, (vi) inorganic fine particles may be added for the purpose of adjusting electric charge and improving flowability. The inorganic fine particles are preferably added at the same stage with positively electrifiable silica fine particles in view of the stabilization of electrification property.

External addition of positively electrifiable silica fine particles, titanium oxide fine particles and a fatty acid or a salt thereof to toner mother particles is carried out by machines or methods usually used in this industry, e.g., high speed fluid mixers, such as a Henschel mixer or Perpenmyer, and mixers using a mechanochemical method. Toner 4A can be obtained, for example, by putting toner mother particles, positively electrifiable silica fine particles, titanium oxide fine particles and a long chain fatty acid or a salt thereof into a Henschel mixer and stirring at a predetermined stirring velocity for predetermined time. The velocity and time of stirring in each step can be set independently, but the conditions may be the same.

Since external additives having an electrification property are not included in the manufacturing method of Toner 4A of the fourth invention other than positively electrifiable silica fine particles (e.g., negatively electrifiable silica fine particles), the static attraction between appropriately negatively charged toner mother particles and positively electrifiable silica fine particles is not hindered, and the difference between the work function of positively electrifiable silica fine particles and the work function of toner mother particles is large, so that positively electrifiable silica fine particles can be strongly adhered to toner mother particles. Therefore, the desorption of positively electrifiable silica fine particles is prevented and the fluctuation of electrification property lessens, as a result, an electrification property can be stabilized for a long period of time.

Titanium oxide fine particles have low electrical resistance, accordingly there is high possibility that the electric charge is excessively lost when titanium oxide fine particles are present on the surface of the toner. On the other hand, positively electrifiable silica fine particles are negatively charged and have a high electrical resistance value. Therefore, by externally adding titanium oxide fine particles and positively electrifiable silica fine particles at the same time, the positively electrifiable silica fine particles function as the electric charge adjuster, and the reduction of the electrical resistivity of the toner is controlled and the electric charge is unified.

It is thought that particles comprising a long chain fatty acid or a salt thereof functions as the binding agent of positively electrifiable silica fine particles and titanium oxide fine particles. Accordingly, the addition of particles comprising a long chain fatty acid or a salt thereof is effective to prevent desorption of the positively electrifiable silica fine particles and titanium oxide fine particles, and presumably takes effect in stabilization of electrification property for a long period of time.

By adding these external additives at the same time, the above various effects are exhibited. Further, since positively electrifiable silica fine particles come to be liberated and present in the toner in an appropriate rate, the flowability of the toner becomes good and, at the same time, the free positively electrifiable silica fine particles function as the carrier, so that the electrification property becomes more uniform. It is also thought that particles comprising a long chain fatty acid or a salt thereof have the effect to prevent coagulation of toner, and the function as the auxiliary flowing agent and lubricant.

Toner 4A according to the fourth invention is thus obtained by the method of externally adding a fatty acid or a salt thereof in addition to positively electrifiable silica fine particles and titanium oxide fine particles at the same time, and has a uniform electrification property as compared with the case where positively electrifiable silica fine particles and/or titanium oxide fine particles are added to negatively electrifiable mother particles as disclosed in patent documents 1 to 3. Toner 4A has an excellent effect that uniform electrification property is stably maintained for a long period of time and excellent flowability is maintained for a long period of time as a result of preventing isolation of positively electrifiable silica fine particles or titanium oxide fine particles.

Toner 4B:

Toner 4B is obtained by externally adding positively electrifiable silica fine particles to toner mother particles in the first place, and then titanium oxide fine particles and particles comprising a long chain fatty acid or a salt thereof at the same time.

Since external additives having an electrification property are not included in the manufacturing method of Toner 4B of the fourth invention other than positively electrifiable silica fine particles (e.g., negatively electrifiable silica fine particles), the static attraction between negatively charged toner mother particles and positively electrifiable silica fine particles is not hindered, and the difference between the work function of positively electrifiable silica fine particles and the work function of toner mother particles is large, so that positively electrifiable silica fine particles are strongly adhered to toner mother particles. Therefore, the desorption of positively electrifiable silica fine particles is prevented and the fluctuation of electrification property lessens, as a result, an electrification property can be stabilized for a long period of time.

After the addition of positively electrifiable silica fine particles, titanium oxide fine particles and particles comprising a long chain fatty acid or a salt thereof are added, and by adding positively electrifiable silica fine particles having a high electrical resistance value in advance, the surface electric charge of the toner does not lower greatly when titanium oxide fine particles having low electrical resistance are added (that is, the positively electrifiable silica fine particles function as the electric charge adjuster), the reduction of the electrical resistivity of the toner is controlled and the electric charge is unified. In addition to these effects, the long chain fatty acid or a salt thereof functions as the binding agent and effectively prevents the isolation of the positively electrifiable silica fine particles and the titanium oxide fine particles, and stabilizes electrification stability for a long period of time. Further, the long chain fatty acid or a salt thereof has the effect of preventing coagulation of toner, and functions as auxiliary flowing agent and lubricant.

As described above, Toner 4B of the fourth invention is obtained by the method of externally adding positively electrifiable silica fine particles first, and then titanium oxide fine particles and fatty acid or a salt thereof, and has a uniform electrification property as compared with the case where positively electrifiable silica fine particles and/or titanium oxide fine particles are added to negatively electrifiable mother particles as disclosed in patent documents 1 to 3. Toner 4B has an excellent effect that uniform electrification property is stably maintained for a long period of time and excellent flowability is maintained for a long period of time as a result of preventing liberation of positively electrifiable silica fine particles or titanium oxide fine particles.

(VI) Toner of the Fifth Invention and Manufacturing Method Thereof:

The toner in the fifth invention is a toner obtained by adding external additives to toner mother particles by multistage process, and particles comprising at least a long chain fatty acid or a salt thereof are added in the last stage of the multistage process. The terminology "particles comprising at least a long chain fatty acid or a salt thereof are added" means not only the case where only a long chain fatty acid or a salt thereof are added alone, but also the case where external additives other than the external additives which have been already added are added with a long chain fatty acid or a salt thereof.

As described above, the toner of the fifth invention is characterized in that the toner is obtained by adding a long chain fatty acid or a salt thereof in the last stage of multistage process. It is thought that by adding a long chain fatty acid or a salt thereof finally, the long chain fatty acid or a salt thereof functions as the binder of external additives, such as negatively electrifiable silica fine particles, positively electrifiable silica fine particles and titanium oxide fine particles, and prevents the desorption of these external additives from the surfaces of the toner. It is also thought that by adding a long chain fatty acid or a salt thereof finally, the effect as the lubricant of the toner is further brought out and uniform electrification can be maintained. Further, in repeating use, the stability of electrification can be maintained. This is presumed to be the result that the long chain fatty acid or a salt thereof prevents the coagulation of the toner as the lubricant, and the external additives are prevented from being buried in toner mother particles due to the friction of toner particles. Furthermore, it is thought that the toner is brought into contact with the photo-sensitive material in the developing chamber, thereby the long chain fatty acid or a salt thereof migrates to the surface of the photosensitive material and lubricates the surface of the photosensitive material, as a result, the photosensitive material is prevented from being abraded by the external additives on the surface of the toner.

Further, the toner of the fifth invention exhibits further effects by adopting multistage process as compared with conventional toners which are obtained by the external addition of external additives and a long chain fatty acid or a salt thereof by one time step, or toners which are obtained by adding external additives after the addition of a long chain fatty acid or a salt thereof.

(VI-1) A Case where Toner Mother Particles are Positively Electrifiable to Weakly Negatively Electrifiable:

In performing multistage process when toner mother particles are positively electrifiable to weakly negatively electrifiable, it is preferred that external additives to be added first be negatively electrifiable silica fine particles, negatively electrifiable silica fine particles and titanium oxide fine particles, or titanium oxide fine particles. These steps are described in (VI-1-1) to (VI-1-3) below.

(VI-1-1) Toner Obtained by the Addition of Negatively Electrifiable Silica Fine Particles First:

When negatively electrifiable silica fine particles are added alone, the static attraction between the toner mother particles and the negatively electrifiable silica fine particles is not hindered by positively electrifiable silica fine particles, and the difference between the work function of the negatively electrifiable silica fine particles and the work function of the toner mother particles is large, so that the negatively electrifiable silica fine particles can be strongly adhered to the toner mother particles. Therefore, the desorption of the negatively electrifiable silica fine particles is prevented, the fluctuation of electrification property lessens, as a result, the electrification property can be stabilized for a long period of time. It is preferred to use small particle size silica and large particle size silica in combination as the negatively electrifiable silica fine particles, for the reasons that the absolute value of the quantity of electrification can be made great, electrification stability can be obtained for a long period of time, and it becomes possible to heighten the storage stability of the toner by improving the flowability of the toner and exhibiting the blocking effect against heat.

When negatively electrifiable silica fine particles are added first, titanium oxide fine particles and positively electrifiable silica fine particles are added in the next place. Titanium oxide fine particles and positively electrifiable silica fine particles may be added at the same time, but it is preferred to add titanium oxide fine particles prior to the addition of positively electrifiable silica fine particles. Positively electrifiable silica fine particles are negatively charged and have high electrical resistivity. Therefore, by adding titanium oxide fine particles in advance and then adding positively electrifiable silica fine particles, the positively electrifiable silica fine particles function as the electric charge adjuster, and the reduction of the electrical resistivity of the toner is controlled and the electric charge is unified. Further, since the positively electrifiable silica fine particles come to be liberated and present in the toner in an appropriate rate, the flowability of the toner becomes good and, at the same time, the free positively electrifiable silica fine particles function as the carrier, so that the electrification property becomes more uniform.

There are four-stage process of adding, to toner mother particles, in the order of negatively electrifiable silica fine particles, titanium oxide fine particles, then positively electrifiable silica fine particles alone, and finally particles comprising a long chain fatty acid or a salt thereof; and three-stage process of adding positively electrifiable silica fine particles and particles comprising a long chain fatty acid or a salt thereof in the above third and fourth at the same stages as the last stage. Further, these external additives may be added in two-stage process of adding titanium oxide fine particles, positively electrifiable silica fine particles and particles comprising a long chain fatty acid or a salt thereof at the same stage to negatively electrifiable silica fine particles. Above all, three-stage process of adding positively electrifiable silica fine particles and particles comprising a long chain fatty acid or a salt thereof at the same stage is preferred for the reason that the adjustment of surface electric charge by positively electrifiable silica fine particles and titanium oxide fine particles can be most efficiently performed without extremely reducing the electrical resistance.

As multistage process of adding negatively electrifiable silica fine particles first and finally at least a long chain saturated fatty acid or a salt thereof, e.g., multistage processes of the following (a) to (f) are exemplified: (a) negatively electrifiable silica fine particles–titanium oxide fine particles–positively electrifiable silica fine particles–a long chain saturated fatty acid or a salt thereof; (b) negatively electrifiable silica fine particles–titanium oxide fine particles–(positively electrifiable silica fine particles+a long chain saturated fatty acid or a salt thereof); (c) negatively electrifiable silica fine particles–titanium oxide fine particles–a long chain saturated fatty acid or a salt thereof; (d) negatively electrifiable silica fine particles–(titanium oxide fine particles+a long chain saturated fatty acid or a salt thereof); (e) negatively electrifiable silica fine particles–(titanium oxide fine particles+positively electrifiable silica fine particles); and (f) negatively electrifiable silica fine particles–positively electrifiable silica fine particles–a long chain saturated fatty acid or a salt thereof.

As described above, the toner obtained by adding negatively electrifiable silica fine particles first and a long chain fatty acid or a salt thereof in the last stage shows the effect of strong adhesion of the negatively electrifiable silica fine particles to the toner mother particles, and the effects by the final addition of the long chain fatty acid or a salt thereof are exhibited, therefore, the toner has excellent properties, such that the isolation of the silica fine particles is controlled and a uniform electrification property is maintained for a long period of time, as compared with conventional toners which are obtained by one time step.

(VI-1-2) Toner Obtained by the Addition of Negatively Electrifiable Silica Fine Particles and Titanium Oxide Fine Particles First:

Negatively electrifiable silica fine particles and titanium oxide fine particles may be added to toner mother particles at the same time in the first place. Since the negatively electrifiable silica fine particles strongly adhere to the toner mother particles from the relationship between the work function of the negatively electrifiable silica fine particles, the work function of the titanium oxide fine particles, and the work function of the toner mother particles, the isolation of the silica fine particles is controlled. In addition, the effects due to the final addition of the long chain saturated fatty acid or a salt thereof are exhibited.

As such multistage process, (g) (negatively electrifiable silica fine particles+titanium oxide fine particles)–positively electrifiable silica fine particles–a long chain saturated fatty acid or a salt thereof; and (h) (negatively electrifiable silica fine particles+titanium oxide fine particles)–(positively electrifiable silica fine particles+a long chain saturated fatty acid or a salt thereof) are exemplified.

(VI-1-3) Toner Obtained by the Addition of Titanium Oxide Fine Particles First:

When titanium oxide fine particles are added first, it is preferred to add negatively electrifiable silica fine particles in the next place. This is due to consideration of strongly adhering negatively electrifiable silica fine particles to toner mother particles in the first place, thinking the respective work functions of toner mother particles, positively electrifiable silica fine particles and negatively electrifiable silica fine particles. In the next place, according to necessity, by adding positively electrifiable silica fine particles prior to, or at the same stage with, a long chain fatty acid or a salt thereof, the quantity of electrification can be adjusted with preventing the sudden reduction of the quantity of electrification. In addition to this effect, the effects by the long chain fatty acid or a salt thereof are exhibited.

As such multistage process, (i) titanium oxide fine particles–negatively electrifiable silica fine particles–positively electrifiable silica fine particles–a long chain saturated fatty acid or a salt thereof; (j) titanium oxide fine particles–negatively electrifiable silica fine particles–(positively electrifiable silica fine particles+a long chain saturated fatty acid or a salt thereof); and (k) titanium oxide fine particles–negatively electrifiable silica fine particles–a long chain saturated fatty acid or a salt thereof; are exemplified.

(VI-2) A Case Where Toner Mother Particles are Negatively Charged:

When toner mother particles are negatively electrified, it is preferred for the negatively electrifiable toner mother particles to have the quantity of electrification of from −5 to −60 μC/g. In multistage process of the negatively charged toner mother particles, negatively electrifiable silica fine particles are not generally used. However, when the degree of negative electrification is weak, negatively electrifiable silica fine particles are used at times for the purpose of adjusting the electric charge. External additives are added so that the quantity of electrification of the toner obtained generally becomes from −7 to −30 μC/g.

When negatively electrifiable toner mother particles are used, multistage process of adding positively electrifiable silica fine particles first; adding positively electrifiable silica fine particles and other external additives first; and adding titanium oxide fine particles first are exemplified. These steps are described in (VI-2-1) to (VI-2-3) below.

(VI-2-1) Toner Obtained by the Addition of Positively Electrifiable Silica Fine Particles First:

It is most preferred to add positively electrifiable silica fine particles first. According to the process, the static attraction between the negatively electrifiable toner mother particles and the positively electrifiable silica fine particles is not hindered, and the difference between the work function of the positively electrifiable silica fine particles and the work function of the toner mother particles is large, so that the positively electrifiable silica fine particles are strongly adhered to the toner mother particles. Therefore, the desorption of the positively electrifiable silica fine particles is prevented, the fluctuation of the electrification property lessens, as a result, the electrification property can be stabilized for a long period of time.

After the addition of positively electrifiable silica fine particles, titanium oxide fine particles are added alone or together with particles comprising a long chain fatty acid or a salt thereof. By adding positively electrifiable silica fine particles having a high electrical resistance value in advance, the surface electric charge of the toner does not lower greatly when titanium oxide fine particles low in electrical resistance are added (that is, the positively electrifiable silica fine particles function as the electric charge adjuster), the reduction of the electrical resistivity of the toner is controlled and the electric charge is unified. In addition to these effects, the effects due to the final addition of the long chain fatty acid or a salt thereof are exhibited.

As such multistage process, (1) positively electrifiable silica fine particles–a long chain fatty acid or a salt thereof; and (m) positively electrifiable silica fine particles–(titanium oxide fine particles+a long chain fatty acid or a salt thereof) are exemplified.

Negatively electrifiable toner mother particles are not contained as the external additive in this multistage process. A toner not containing negatively electrifiable toner mother particles as the external additive has good electrification properties and good flowability. This toner has advantages that the fixing temperature of the toner can be made low (the fixing temperature in a fixing chamber can be set low), and the fixing strength of the image after fixation is satisfactory.

(VI-2-2) Toner Obtained by the Addition of Positively Electrifiable Silica Fine Particles and Other External Additives First:

When other external additive is negatively electrifiable silica fine particles, considering that the toner mother particles are negatively charged, it is preferred from the point of electrification control to add positively electrifiable silica fine particles at the same time with negatively electrifiable silica fine particles in the first place. As multistage process of adding positively electrifiable silica fine particles and negatively electrifiable silica fine particles in the first place, (n) (positively electrifiable silica fine particles+negatively electrifiable silica fine particles)–titanium oxide fine particles–a long chain fatty acid or a salt thereof; (o) (positively electrifiable silica fine particles+negatively electrifiable silica fine particles+titanium oxide fine particles)–a long chain fatty acid or a salt thereof; and (p) (positively electrifiable silica fine particles+negatively electrifiable silica fine particles)–a long chain fatty acid or a salt thereof, are exemplified.

In the above example (p) of multistage process, titanium oxide fine particles are not added, but when the quantity of electrification is in a proper range, they may not be added.

(VI-2-3) Toner Obtained by the Addition of Titanium Oxide Fine Particles First:

Titanium oxide fine particles may be added first, and as such multistage process, (q) titanium oxide fine particles–negatively electrifiable silica fine particles–positively electrifiable silica fine particles–a long chain fatty acid or a salt thereof; and (r) titanium oxide fine particles–negatively electrifiable silica fine particles–(positively electrifiable silica fine particles+a long chain fatty acid or a salt thereof) are exemplified.

The orders in the above multistage processes (a) to (r) are exemplifications and the fifth invention is not limited thereto. In addition, if necessary, inorganic fine particles described in the above (vi) may be added with a view to adjusting electric charge and improving flowability. Inorganic fine particles may be added in any stage provided that they are added before or at the same stage with the addition of a long chain fatty acid or a salt thereof.

As described above, the external additives of the toner of the fifth invention are strongly adhered to toner mother particles in multistage process by the work function of each external additive and the work function of toner mother particles, and the isolation controlling effect of external additives is further reinforced by the binding function of the long chain fatty acid or a salt thereof added in the last stage. Further, uniformity of electrification and long term stability of electrification are strengthened, and the stability of electrification is maintained in repeating use. In addition, preventing effect of coagulation of toner, and the effects as auxiliary flowing agent and lubricant can be sufficiently shown. Further, it is thought that the toner is brought into contact with the photosensitive material, as a result the long chain fatty acid or a salt thereof migrates to the surface of the photosensitive material and lubricates the surface of the photosensitive material, thereby the effect of preventing a photosensitive material from being abraded by the external additives on the surface of the toner is further heightened.

On the other hand, conventional toners, e.g., the toners disclosed in patent documents 1 to 4, are toners obtained by externally adding positively electrifiable silica fine particles and negatively electrifiable silica fine particles at the same time, and it is thought that by adding positively electrifiable silica fine particles and negatively electrifiable silica fine particles at the same time, the static attraction between the toner mother particles and the negatively electrifiable silica fine particles becomes small, as a result, the desorption of the negatively electrifiable silica fine particles are liable to occur. Further, it is also presumed that since conventional toners do not contain a long chain fatty acid or a salt thereof, the isolation of negatively electrifiable and/or positively electrifiable silica fine particles or titanium oxide fine particles cannot be restrained.

Addition of negatively electrifiable silica fine particles, titanium oxide fine particles, positively electrifiable silica fine particles and a long chain fatty acid or a salt thereof to toner mother particles is carried out by machines or methods usually used in this industry, e.g., high speed fluid mixers, such as a Henschel mixer or Perpenmyer, and mixers using a mechanochemical method. The velocity and time of stirring in each step of multistage process can be set independently, but the conditions may be the same.

The toner of the present invention can be used in any type of image-forming apparatus, e.g., image-forming apparatus using one-component series toners, or image-forming apparatus using two-component series toners, may be used. Image-forming apparatus of a contact development system or image-forming apparatus of a non-contact development system may also be used. Image-forming apparatus of a contact development system using one-component series toners capable of using the toner of the present invention are described in detail, e.g., in patent document 13. The image-forming apparatus of the present invention is equipped with at least a latent image carrier on which an electrostatic latent image is formed represented by a photosensitive material; a toner carrier for carrying a toner to the latent image carrier for developing the electrostatic latent image on the latent image carrier represented by a developing roller; and a developing chamber having a toner regulating member to regulate the amount of the toner carried to the latent image carrier by the toner carrier. The toner of the present invention is held in a toner holder, carried from the toner holder to the developing roller (the toner carrier) and supplied to the photosensitive material (the latent image carrier) via the developing roller (the toner carrier), transferred, thereby an image is formed. The toner regulating member adjusts the amount of the toner so that an excess amount of the toner is not supplied to the photosensitive material (the latent image carrier) from the developing roller (the toner carrier).

EXAMPLES

The present invention is illustrated with reference to examples below. In the first place, the evaluation methods in the present invention are described. Items and methods of evaluations are as follows.

1. Isolation Rate of External Additives (Silica Fine Particles, Titanium Oxide Fine Particles):

The isolation rate of external additives (silica fine particles and titanium oxide fine particles) was measured with PT1000 Particle Analyzer (a product of Yokogawa Electric Corporation). The details of measuring method of the isolation rate of external additives are disclosed in patent document 13 (JP-A-2002-202622). Describing the principle in brief, isolation rate is obtained by introducing toner particles into plasma, exciting the toner particle to emit light, and measuring the intensity and time of the emission. For example, toner particles to which external additive $SiO_2$ has been added are introduced into plasma, and the emission intensity of $SiO_2$ in the toner particles is measured. Assuming that the toner particle to which $SiO_2$ has been externally added is a spherical particle, the particle size of the spherical particle (equivalent particle size) is obtained from the emission intensity. Similarly to the case of the toner particle, the equivalent particle size of the liberated $SiO_2$ can be obtained from the emission intensity. However, since the emission intensity of the liberated $SiO_2$ is small, the equivalent particle size is small. Accordingly, the liberated external additive can be distinguished from the toner particles by comparing equivalent particle sizes. Therefore, the isolation rate of $SiO_2$ can be obtained according to the following equation (X), by obtaining all the detected number of external additive $SiO_2$, and taking the number of individuals having smaller equivalent particle size as the number of particles of the liberated external additive.

$$\text{Isolation rate} = (\text{detected number of liberated external additive}/\text{all detected number of external additive}) \times 100\ (\%) \quad (X)$$

Whether $SiO_2$ is adhered to a toner particle or liberated is distinguished by making use of the fact that $SiO_2$ adhered to a toner particle emits light synchronously with the toner particle, but $SiO_2$ which is not adhered to a toner particle does not radiate synchronously with the toner particle and the time of emission deviates from that of the toner particle (asynchronously). On the basis of the measured value, the isolation rate can be obtained by the following equation (Y).

$$\text{Isolation rate} = (\text{asynchronous count of external additive}/\text{asynchronous count} + \text{synchronous count of external additive}) \times 100\ (\%) \quad (Y)$$

A method represented by equation (Y) was adopted in the fifth invention. In addition, the measurement of the isolation rate of titanium oxide fine particles is performed in the same manner as above by exciting titanium oxide fine particles to emit light in plasma. The volume average particle size of toner mother particles can also be obtained, e.g., by making a colorant contained in the toner mother particles emit light in plasma, and obtaining the equivalent particle size.

2. Uniformity of Quantity of Electrification and Electrification:

The quantity of electrification of a toner is measured as follows with E-SPART Analyzer (manufactured by HOSOKAWA MICRON CORPORATION). Each of the toners prepared in Examples and Comparative Examples and carrier were mixed and stirred, to thereby electrify the toner. Nitrogen gas was then blown to the mixture of the toner and the carrier to separate the toner and the carrier. In the next place, the quantity of electrification of every toner (Q/m) was measured, and the distribution of the quantities of electrification of the toners was obtained. The uniformity of electrification is judged as follows. In number distribution of the quantity of electrification of every one toner (Q/m), the difference between the quantity of electrification of the maximum frequency ($Q_1/m_1$) and the value obtained by dividing the total quantity of electrification of the measured toners by the measured count (the number) ($Q_2/m_2$), i.e., the smaller the absolute value of $(Q_1/m_1)-(Q_2/m_2)$, the sharper is the distribution of the quantity of electrification (uniform), and the greater the absolute value of $(Q_1/m_1)-(Q_2/m_2)$, the broader is the distribution of the quantity of electrification (nonuniform).

As the carrier, KBN100 ferrite carrier (manufactured by Hitachi Metals, Ltd.) was used.

3. Electrical Resistivity of Toner:

Electrical resistivity was measured with a hybrid type electrical resistivity tester model DRT-1 (manufactured by SANKYO PIO-TECH CO., Ltd.) according to JIS B9915.

4. Durability Test:

A copier (model LP-9300 manufactured by Seiko Epson Corporation) was charged with a toner, and printing of 3,000 sheets was performed. Printing was begun when 5% of the toner was consumed, and the distribution of electrification, electrical resistivity and the isolation rate of the external-additives before and after printing were measured.

The first invention is illustrated with reference to examples below.

Preparation of Toner Mother Particles of the First Invention:

One hundred (100) parts by weight of a styrene-acrylic-based binder resin, 3.5 parts by weight of a red pigment (C.I. 12055), and 1.0 part by weight of chromium salicylate complex were put into Henschel Mixer FM 20B (a product of MITSUI MINING COMPANY, LIMITED), and homogeneously blended. The mixture was melt-kneaded with a two-shaft kneading extruder PCM-30 (manufactured by IKEGAI KASEI CO., LTD), and after cooling, pulverized by jet air with a jet pulverizer 200AFG (a product of HOSOKAWA MICRON CORPORATION). The pulverized product was classified with a wind power classifier 100ATP (a product of HOSOKAWA MICRON CORPORATION), to thereby prepare toner mother particles having a volume average particle size of 8.5 μm.

External Additives:

The external additives externally added to toner mother particles in Examples of the first invention are shown in Table 1-1 below.

TABLE 1-1

| | External Additive | Trade Name | | Average Particle Size | Manufacturer |
|---|---|---|---|---|---|
| $1a_1$ | Negatively electrifiable silica | Negatively electrifiable hydrophobic silica | RX200 | 15 nm | Nippon Aerosil Co., Ltd. |
| $1a_2$ | Negatively electrifiable silica | Negatively electrifiable hydrophobic silica | RX50 | 40 nm | Nippon Aerosil Co., Ltd. |
| 1b | Titanium oxide | Hydrophobic titanium oxide*) | STT-30S | Long axis: 20 nm | TITAN KOGYO KABUSHIKI KAISHA |
| 1c | Positively electrifiable silica | Positively electrifiable hydrophobic silica | NA50H | 30 nm | Nippon Aerosil Co., Ltd. |
| 1d | Long chain fatty acid salt | Magnesium stearate | | | |

*)Rutile-anatase type

External Addition Process:

In Examples of the first invention, external addition process in each process was performed by adding predetermined amounts of external additives to 100 parts by weight of toner mother particles, and stirring the constituents by using a Henschel Mixer FM20B (a product of MITSUI MINING COMPANY, LIMITED) for 3 minutes with Z0S0 type stirring blades at 2,000 rpm. For example, in manufacturing step (II-2) of toner 1A, a predetermined amount of titanium oxide fine particles to 100 parts by weight of the toner mother particles were added to the mixture obtained in step (II-1) and the mixture was subjected to stirring process with a Henschel Mixer FM20B on the same condition as above.

Example 1-1

Preparation of Toner 1A:

External addition process was performed by adding 1 part by weight of RX200 to 100 parts by weight of the above-obtained toner mother particles (step (II-1)). External addition process was performed by adding 0.5 part by weight of STT-30S to the mixture obtained in step (II-1) (step (II-2)). Subsequently, external addition process was performed by adding 0.5 part by weight of NA50H to the mixture obtained in step (II-2) (step (II-3)), thereby toner 1A was obtained. The process is described in Table 1-2 below.

Example 1-2

Preparation of Toner 1B:

Toner 1B was prepared by external addition of further adding 0.1 part by weight of magnesium stearate powder to toner 1A obtained in Example 1-1. The process is described in Table 1-2 below.

Example 1-3

Preparation of Toner 1C1:

External addition process was performed by adding 1 part by weight of RX200 to 100 parts by weight of the toner mother particles (step (II-1)). External addition process was performed by adding 0.5 part by weight of STT-30S to the mixture obtained in step (II-1) (step (II-2)). Subsequently, external addition process was performed by adding 0.5 parts by weight of NA50H and 0.1 part by weight of magnesium stearate to the toner obtained in step (II-2) (step (II-3)), thereby toner 1C1 was prepared. The process is described in Table 1-2 below.

Example 1-4

Preparation of Toner 1C2 :

Toner 1C2 was prepared in the same manner as in Example 1-3 by external addition process, except for adding 0.5 part by weight of RX200 and 0.5 part by weight of RX50 in place of adding 1 part by weight of RX200 in step (II-1). The process is described in Table 1-2 below.

Comparative Example 1-1

Preparation of Toner 1D:

Toner D of Comparative Example 1-1 was prepared in the same manner as in Example 1-1, except that external addition process by blending negatively electrifiable silica fine particles, titanium oxide fine particles, and positively electrifiable silica fine particles in the same proportion as in Example 1-1 was performed at a time. The process is described in Table 1-2 below.

Comparative Example 1-2

Preparation of Toner 1E:

Toner E of Comparative Example 1-2 was prepared by the same external addition process as in Example 1-1, except that the order of step (II-2) and step (II-3) was replaced, i.e., positively electrifiable silica fine particles were added after negatively electrifiable silica fine particles, and then titanium oxide fine particles were added. The process is described in Table 1-2 below.

Comparative Example 1-3

Preparation of Toner 1F:

Toner F of Comparative Example 1-3 was prepared by the same external addition process as in Example 1-1, except for omitting step (II-3) (positively electrifiable silica fine particles were added). The process is described in Table 1-2 below.

Comparative Example 1-4

Preparation of Toner 1G:

Toner G of Comparative Example 1-4 was prepared in the same manner as in Example 1-2, except that external addition process by blending negatively electrifiable silica fine particles, titanium oxide fine particles, and positively electrifiable silica fine particles in the same proportion as in Example 1-2 was performed at a time. The process is described in Table 1-2 below.

TABLE 1-2

| | External Additives | | | | | Order of External Addition | | | | |
|---|---|---|---|---|---|---|---|---|---|---|
| | 1a1 | 1a2 | 1b | 1c | 1d | First Stage | Second Stage | Third Stage | Fourth Stage | |
| Example 1-1 | 1.0 | — | 0.5 | 0.5 | — | 1a1 | 1b | 1c | — | Toner 1A |
| Example 1-2 | 1.0 | — | 0.5 | 0.5 | 0.1 | 1a1 | 1b | 1c | 1d | Toner 1B |
| Example 1-3 | 1.0 | — | 0.5 | 0.5 | 0.1 | 1a1 | 1b | 1c + 1d | — | Toner 1C1 |
| Example 1-4 | 0.5 | 0.5 | 0.5 | 0.5 | 0.1 | 1a1 + 1a2 | 1b | 1c + 1d | — | Toner 1C2 |
| Comparative Example 1-1 | 1.0 | — | 0.5 | 0.5 | — | 1a1 + 1b + 1c | — | — | — | Toner 1D |
| Comparative Example 1-2 | 1.0 | — | 0.5 | 0.5 | — | 1a1 | 1c | 1b | — | Toner 1E |
| Comparative Example 1-3 | 1.0 | — | 05 | — | — | 1a1 | 1b | — | — | Toner 1F |

TABLE 1-2-continued

| | External Additives | | | | | Order of External Addition | | | | |
|---|---|---|---|---|---|---|---|---|---|---|
| | 1a1 | 1a2 | 1b | 1c | 1d | First Stage | Second Stage | Third Stage | Fourth Stage | |
| Comparative Example 1-4 | 1.0 | — | 0.5 | 0.5 | 0.1 | 1a1 + 1b + 1c + 1d | — | — | — | Toner 1G |

The numeral in the column of External Additives shows the addition amount (parts by weight) to 100 parts by weight of toner mother particles.

Example 1-5

Toners 1A to 1G obtained by the above methods (Table 1-2) were evaluated by the evaluation method described above.

The results of the above evaluation are shown in Table 1-3 below.

TABLE 1-3

| | | a $Q_1/m_1$ (μC/g) | b $Q_2/m_2$ (μC/g) | c a − b (μC/g) | Electrical Resistivity (Ω · cm) | Isolation Rate of Silica (%) | Isolation Rate of Titanium Oxide (%) |
|---|---|---|---|---|---|---|---|
| Example 1-1 | Toner 1A | −12.48 | −15.69 | 3.21 | $4.2 \times 10^{16}$ | 0.43 | 0.68 |
| Example 1-2 | Toner 1B | −11.86 | −12.26 | 0.40 | $4.3 \times 10^{16}$ | 0.38 | 0.46 |
| Example 1-3 | Toner 1C1 | −11.53 | −11.66 | 0.13 | $4.4 \times 10^{16}$ | 0.38 | 0.51 |
| Example 1-4 | Toner 1C2 | −11.56 | −11.69 | 0.13 | $4.1 \times 10^{16}$ | 0.39 | 0.43 |
| Comparative Example 1-1 | Toner 1D | −13.56 | −19.63 | 6.07 | $4.6 \times 10^{16}$ | 0.89 | 1.06 |
| Comparative Example 1-2 | Toner 1E | −12.96 | −16.31 | 3.35 | $4.5 \times 10^{16}$ | 0.46 | 1.28 |
| Comparative Example 1-3 | Toner 1F | −13.44 | −20.68 | 7.24 | $7.9 \times 10^{15}$ | 0.38 | 0.98 |
| Comparative Example 1-4 | Toner 1G | −12.96 | −16.31 | 3.35 | $4.5 \times 10^{16}$ | 0.46 | 1.28 |

From the results of column c in Table 1-3, it can be seen that the toners obtained by the external addition of negatively electrifiable silica fine particles, titanium oxide fine particles, positively electrifiable silica fine particles and particles comprising a long chain fatty acid or a salt thereof in the specific order are excellent in the uniformity of electrification, low in the isolation rate of silica fine particles, and also very low in the isolation rate of titanium oxide fine particles, as compared with the case where these external additives are added at the same time (Comparative Examples.1-1 and 1-4), the case where titanium oxide fine particles and positively electrifiable silica fine particles are added in the reverse order (Comparative Example 1-2), and the case where positively electrifiable silica fine particles and particles comprising a long chain fatty acid or a salt thereof are not externally added.

In Example 1-1 and Comparative Example 1-1, negatively electrifiable silica fine particles, titanium oxide fine particles and positively electrifiable silica fine particles are used in the same amounts respectively. However, it is suggested by the results of the isolation rates of silica that strong adhesion of negatively electrifiable silica fine particles is brought about by changing the methods of external addition.

Further, it can be seen from the comparison of Example 1-1 and Comparative Example 2 that the isolation rate of titanium oxide fine particles greatly reduces by the external addition in the order of titanium oxide fine particles—positively electrifiable silica fine particles (Example 1-1) in place of the order of positively electrifiable silica fine particles—titanium oxide fine particles (Comparative Example 1-2).

It is seen from the comparison of the results in Example 1-1 and Comparative Example 1-3 that the electrical resistance of a toner does not extremely reduce even when titanium oxide fine particles and positively electrifiable silica fine particles are used in combination and the adjustment of electric charge is possible. When titanium oxide fine particles are present on the surface of a toner, the electric charge is liable to be lost excessively easily, since the electrical resistance value is small, but the excess vanishing of electric charge can be prevented and the electric charge of the toner at large can be adjusted to a lower level and uniform by performing external addition in the order of titanium oxide fine particles—positively electrifiable silica fine particles.

From the comparison of the results in Examples 1-2 tol-4 and in Comparative Example 1-4, it can be seen that the amount of liberated silica fine particles and titanium oxide fine particles lowers (in other words, the silica fine particles are efficiently taken in the toner mother particles) by adding a metal salt of a long chain fatty acid (magnesium stearate) after the external addition of positively electrifiable silica fine particles or at the same time with positively electrifiable silica fine particles. By this fact, it becomes possible to lessen the aging fluctuation of electric charge at use time.

Of these toners, since the toners of Examples 1-3 and 1-4 show a uniform electrification property, and the isolation rate of the titanium oxide fine particles of the toner of Example 1-4 is small, it is thought that the electrification is maintained uniform also at use time.

Example 1-6

A copier (model LP-9300 manufactured by Seiko Epson Corporation) was charged with the toner obtained in Example 1-4, and printing of 3,000 sheets was performed. Printing was begun when 5% of the toner was consumed, and properties of the toner before and after printing were compared. The results obtained are shown in Table 1-4 below. The results of toner 1C1 obtained in Example 1-3 wherein negatively electrifiable silica a1 and a2 are not used in combination, and the results of toner G obtained in Comparative Example 1-4 are also shown in Table 1-4 for comparison.

TABLE 1-4

| | | a $Q_1/m_1$ (μC/g) | b $Q_2/m_2$ (μC/g) | c a − b (μC/g) | Electrical Resistivity (Ω · cm) | Isolation Rate of Silica (%) | Isolation Rate of Titanium Oxide (%) |
|---|---|---|---|---|---|---|---|
| Example 1-4 Toner 1C2 | Initial stage | −11.56 | −11.69 | 0.13 | $4.1 \times 10^{16}$ | 0.39 | 0.43 |
| | After printing 3,000 sheets | −12.79 | −13.56 | 0.77 | $4.3 \times 10^{16}$ | 0.38 | 0.63 |
| Example 1-3 Toner 1C1 | Initial stage | −11.53 | −11.66 | 0.13 | $4.4 \times 10^{16}$ | 0.38 | 0.51 |
| | After printing 3,000 sheets | −15.29 | −17.81 | 2.52 | $5.3 \times 10^{16}$ | 0.42 | 0.69 |
| Comparative Example 1-4 Toner 1G | Initial stage | −12.96 | −16.31 | 3.35 | $4.5 \times 10^{16}$ | 0.46 | 1.28 |
| | After printing 3,000 sheets | −14.81 | −19.63 | 4.82 | $6.2 \times 10^{16}$ | 0.49 | 1.58 |

The toners of Examples 1-3 and 1-4 are greatly improved in the point of the isolation rates of silica and titanium oxide as compared with the toner of Comparative Example 1-4. From the comparison of the toners in Examples 1-3 and 1-4, it can be seen that the isolation rate of the titanium oxide fine particles after printing 3,000 sheets is small in both toners and uniform electrification properties are maintained, in particular the increase in the isolation rate in toner 1C2 obtained in Example 1-4 wherein negatively electrifiable silica a1 and a2 are used in combination is less than the increase in the isolation rate in toner 1C1 in Example 1-3 wherein a1 and a2 are not used in combination. This fact shows that the fluctuation of the quantity of electrification, the electric resistivity, and the isolation of silica and titanium oxide of a toner with the increase of the number of sheets of printing can be restrained by using two kinds of negatively electrifiable silica fine particles each having a different particle size in an appropriate weight ratio.

The second invention is illustrated with reference to examples below.

Preparation of Toner Mother Particles of the Second Invention:

One hundred (100) parts by weight of a styrene-acrylic-based binder resin, 3.5 parts by weight of a red pigment (C.I. 12055), and 1.0 part by weight of chromium salicylate complex were put into Henschel Mixer FM 20B (a product of MITSUI MINING COMPANY, LIMITED), and homogeneously blended. The mixture was melt-kneaded with a two-shaft kneading extruder PCM-30 (manufactured by IKEGAI KASEI CO., LTD), and after cooling, pulverized by jet air with a jet pulverizer 200AFG (a product of HOSOKAWA MICRON CORPORATION). The pulverized product was classified with a wind power classifier 100ATP (a product of HOSOKAWA MICRON CORPORATION), to thereby prepare toner mother particles having a volume average particle size of 8.5 μm.

External Additives:

The external additives externally added to toner mother particles in Examples of the second invention are shown in Table 2-1 below.

TABLE 2-1

| | External Additive | Trade Name | | Average Particle Size | Manufacturer |
|---|---|---|---|---|---|
| 2a1 | Negatively electrifiable silica | Negatively electrifiable hydrophobic silica | RX200 | 15 nm | Nippon Aerosil Co., Ltd. |
| 2a2 | Negatively electrifiable silica | Negatively electrifiable hydrophobic silica | RX50 | 40 nm | Nippon Aerosil Co., Ltd. |
| 2b | Titanium oxide | Hydrophobic titanium oxide*) | STT-30S | Long axis: 20 nm | TITAN KOGYO KABUSHIKI KAISHA |
| 2c | Positively electrifiable silica | Positively electrifiable hydrophobic silica | NA50H | 30 nm | Nippon Aerosil Co., Ltd. |
| 2d | Long chain fatty acid salt | Magnesium stearate | | | |

*)Rutile-anatase type

External Addition Process:

In the examples of the second invention, external addition process in each process was performed by adding predetermined amounts of external additives to 100 parts by weight of toner mother particles, and stirring the constituents by using a Henschel Mixer FM20B (a product of MITSUI MINING COMPANY, LIMITED) for 3 minutes with Z0S0 type stirring blades at 2,000 rpm. For instance, in step (III-1), negatively electrifiable silica fine particles were added to toner mother particles and subjected to stirring process with a Henschel Mixer FM20B on the same condition as above, in the next place titanium oxide fine particles, positively electrifiable silica fine particles, and a long chain fatty acid or a salt thereof respectively in predetermined amounts to 100 parts by weight of the toner mother particles were added to the toner mother particles obtained in step (III-1) to which negatively electrifiable silica fine particles were externally added, and subjected to stirring process with a Henschel Mixer FM20B on the same condition as above.

Example 2-1

Preparation of Toner 2A:

Toner 2A was prepared by the external addition process of adding 1.0 part by weight of RX200 to 100 parts by weight of the above-obtained toner mother particles (step (III-1)), and by the external addition process of adding 1.0 part by weight of STT-30S (hydrophobic titanium oxide), 0.5 parts by weight of NA50H, and 0.1 part by weight of magnesium stearate powder at the same stage to the toner mother particles obtained in step (III-1) to which negatively electrifiable silica fine particles were externally added obtained in step (III-1) (step (III-2)). The process is described in Table 2-2 below.

Example 2-2

Preparation of Toner 2B:

Toner 2B was prepared by the same external addition process as in Example 2-1, except for adding 0.5 parts by weight of RX200 (small particle size silica) and 0.5 parts by weight of RX50 (large particle size silica) at the same time in step (III-1) in Example 2-1 in place of adding 1.0 part by weight of RX200. The process is described in Table 2-2 below.

Comparative Example 2-1

Preparation of Toner 2C:

Toner 2C of Comparative Example 2-1 was prepared by the external addition process of adding 0.5 parts by weight of RX200, 0.5 parts by weight of RX50, 1.0 part by weight of STT-30S, 0.5 parts by weight of NA50H, and 0.1 part by weight of magnesium stearate powder to 100 parts by weight of toner mother particles. The process is described in Table 2-2 below.

Comparative Example 2-2

Preparation of Toner 2D:

Toner 2D of Comparative Example 2-2 was-prepared by the same external addition process as in Example 2-1, except that positively electrifiable silica fine particles were not used in step (III-2) in Example. The process is described in Table 2-2 below.

TABLE 2-2

| | External Additives | | | | | Order of External Addition | | |
|---|---|---|---|---|---|---|---|---|
| | 2a1 | 2a2 | 2b | 2c | 2d | First Stage | Second Stage | |
| Example 2-1 | 1.0 | — | 1.0 | 0.5 | 0.1 | 2a1 | 2b + 2c + 2d | Toner 2A |
| Example 2-2 | 0.5 | 0.5 | 1.0 | 0.5 | 0.1 | 2a1 + 2a2 | 2b + 2c + 2d | Toner 2B |
| Comparative Example 2-1 | 0.5 | 0.5 | 1.0 | 0.5 | 0.1 | 2a1 + 2a2 + 2b + 2c + 2d | — | Toner 2C |
| Comparative Example 2-2 | 1.0 | — | 1.0 | — | 0.1 | 2a1 | 2b + 2d | Toner 2D |

The numeral in the column of External Additives shows the addition amount (parts by weight) to 100 parts by weight of toner mother particles.

Example 2-3

Toners 2A to 2D obtained by the above methods (Table 2-2) were evaluated by the evaluation method described above. The results of the above evaluation are shown in Table 2-3 below.

TABLE 2-3

| | | a $Q_1/m_1$ (μC/g) | b $Q_2/m_2$ (μC/g) | c a − b (μC/g) | Electrical Resistivity (Ω · cm) | Isolation Rate of Silica (%) | Isolation Rate of Titanium Oxide (%) |
|---|---|---|---|---|---|---|---|
| Example 2-1 | Toner 2A | −12.12 | −16.11 | 3.99 | $4.3 \times 10^{16}$ | 0.39 | 0.49 |
| Example 2-2 | Toner 2B | −13.15 | −16.63 | 3.48 | $4.1 \times 10^{16}$ | 0.41 | 0.56 |
| Comparative Example 2-1 | Toner 2C | −9.22 | −15.89 | 6.67 | $8.9 \times 10^{15}$ | 0.78 | 0.79 |

TABLE 2-3-continued

| | a $Q_1/m_1$ (μC/g) | b $Q_2/m_2$ (μC/g) | c a − b (μC/g) | Electrical Resistivity (Ω · cm) | Isolation Rate of Silica (%) | Isolation Rate of Titanium Oxide (%) |
|---|---|---|---|---|---|---|
| Comparative Example 2-2 Toner 2D | −18.74 | −22.56 | 3.82 | $4.5 \times 10^{16}$ | 0.46 | 0.61 |

From the results in Table 2-3, it can be confirmed that toners 2A and 2B (Examples 2-1 and 2-2) of the second invention which are obtained by externally adding negatively electrifiable silica fine particles, and then externally adding titanium oxide fine particles, positively electrifiable silica fine particles, and a long chain fatty acid or a salt thereof at the same stage are excellent in the uniformity of electrification, low in the isolation rates of silica fine particles and titanium oxide fine particles, and low in the electric resistivity of the toner as compared with the case where all of the external additives are added at the same time (Comparative Example 2-1, Toner 2C). This is presumably because the negatively electrifiable silica fine particles strongly adhere to the toner mother particles, in the relationship of the work function, by performing external addition process of negatively electrifiable silica fine particles in the first place, as a result, the isolation rate of the silica fine particles lowers.

Further, when toners 2A and 2B are compared with the case where positively electrifiable silica fine particles are not added (Comparative Example 2-2, Toner 2D), the electric charge of Toner 2D strongly negatively charged, thus the electric charge is not adjusted, as a result an image of low density is formed. On the other hand, toners 2A and 2B according to the second invention to which positively electrifiable silica fine particles, titanium oxide fine particles, and a long chain fatty acid or a salt thereof are added at the same stage can adjust the electric charge of the toners without extremely lowering the electrical resistance value of the toner. In addition, the isolation rates of silica fine particles and titanium oxide fine particles also reduce by the binding effect of the long chain fatty acid or a salt thereof.

The third invention is illustrated with reference to examples below.

Preparation of Toner Mother Particles of the Third Invention:

One hundred (100) parts by weight of a styrene-acrylic-based binder resin, 3.5 parts by weight of a red pigment (C.I. 12055), and 1.0 part by weight of chromium salicylate complex were put into Henschel Mixer FM 20B (a product of MITSUI MINING COMPANY, LIMITED), and homogeneously blended. The mixture was melt-kneaded with a two-shaft kneading extruder PCM-30 (manufactured by IKEGAI KASEI CO., LTD), and after cooling, pulverized by jet air with a jet pulverizer 200AFG (a product of HOSOKAWA MICRON CORPORATION). The pulverized product was classified with a wind power classifier 100ATP (a product of HOSOKAWA MICRON CORPORATION), to thereby prepare toner mother particles having a volume average particle size of 8.5 μm.

External Additives:

The external additives externally added to toner mother particles in Examples of the third invention are shown in Table 3-1 below.

TABLE 3-1

| | External Additive | Trade Name | | Average Particle Size | Manufacturer |
|---|---|---|---|---|---|
| 3a1 | Negatively electrifiable silica | Negatively electrifiable hydrophobic silica | RX200 | 15 nm | Nippon Aerosil Co., Ltd. |
| 3a2 | Negatively electrifiable silica | Negatively electrifiable hydrophobic silica | RX50 | 40 nm | Nippon Aerosil Co., Ltd. |
| 3b | Positively electrifiable silica | Positively electrifiable hydrophobic silica | NA50H | 30 nm | Nippon Aerosil Co., Ltd. |

External Addition Process:

In the examples of the third invention, external addition process in each step was performed by adding predetermined amounts of external additives to 100 parts by weight of toner mother particles, and stirring the constituents by using a Henschel Mixer FM20B (a product of MITSUI MINING COMPANY, LIMITED) for 3 minutes with Z0S0 type stirring blades at 2,000 rpm. For instance, in step (IV-1), negatively electrifiable silica fine particles were added to toner mother particles and subjected to stirring process with a Henschel Mixer FM20B on the same condition as above, in the next place positively electrifiable silica fine particles in a predetermined amount to 100 parts by weight of the toner mother particles were added to the toner mother particles obtained in step (IV-1) to which negatively electrifiable silica fine particles were externally added, and subjected to stirring process with a Henschel Mixer FM20B on the same condition as above.

Example 3-1

Preparation of Toner 3A:

Toner 3A was prepared by the external addition process of adding 1 part by weight of RX200 to 100 parts by weight of the above-obtained toner mother particles (step (IV-1)), and by the external addition process of adding 0.5 parts by weight of NA50H to the product obtained in step (IV-1) (step (IV-2)). The process is described in Table 3-2 below.

Example 3-2

Preparation of Toner 3B:

Toner 3B was prepared by the same external addition process as in Example 3-1, except for adding 0.5 parts by weight of RX200 (small particle size silica) to 100 parts by weight of the toner mother particles and 0.5 parts by weight of RX50 (large particle size silica) at the same time in place of adding 1 part by weight of RX200. The process is described in Table 3-2 below.

Comparative Example 3-1

Preparation of Toner 3C:

Toner 3C of Comparative Example 3-1 was prepared by the same external addition process as in Example 3-1, except for adding 1.0 part by weight of RX200 and 0.5 parts by weight of NA50H to 100 parts by weight of the toner mother particles. The process is described in Table 3-2 below.

Comparative Example 3-2

Preparation of Toner 3D:

Toner 3D of Comparative Example 3-2 was prepared by the same external addition process as in Example 3-1, except for replacing step (IV-1) and step (IV-2) in Example 3-1, i.e., adding RX200 after NA50H. The process is described in Table 3-2 below.

TABLE 3-2

| | External Additives | | | Order of External Addition | | |
|---|---|---|---|---|---|---|
| | 3a1 | 3a2 | 3b | First Stage | Second Stage | |
| Example 3-1 | 1.0 | — | 0.5 | 3a1 | 3b | Toner 3A |
| Example 3-2 | 0.5 | 0.5 | 0.5 | 3a1 + 3a2 | 3b | Toner 3B |
| Comparative Example 3-1 | 1.0 | — | 0.5 | 3a1 + 3b | — | Toner 3C |
| Comparative Example 3-2 | 1.0 | — | 0.5 | 3b | 3a1 | Toner 3D |

The numeral in the column of External Additives shows the addition amount (parts by weight) to 100 parts by weight of toner mother particles.

Evaluation of Toners 3A to 3D:

The toners 3A to 3D respectively obtained by the above methods (Table 3-2) were evaluated by the evaluation method described above. In the third invention, electrification characteristics of a toner were judged synthetically by the uniformity of electrification and the rate of occurring of negatively charged toner.

Occurring Rate of Negatively Charged Toner Particles (Occurring Rate of Positive Toner (%)):

The number of negatively charged toner particles (%) to the total number of toners measured (measurement count) was obtained as the occurring rate of positive toner (%). The occurring rate of negatively charged toner particles is preferably the smaller, considering the uniformity of electrification of the toner.

Judging the uniformity of electrification and the rate of occurring of negatively charged toner synthetically, the smaller the absolute value of $(Q_1/m_1)-(Q_2/m_2)$, and the smaller the occurring rate of negatively charged toner particles (occurring rate of positive toner (%)), the better is the electrification characteristics of the toner.

The results of the above evaluations are shown in Table 3-3 below. "Isolation Rate of Si in First Stage (%)" in Table 3-3 is the isolation rate of the external additives obtained by taking out a sample after the step in the first stage in Table 3-2, and "Isolation Rate of Si in Second Stage (%)" is the isolation rate of the external additives obtained by taking out a sample after the step in the second stage in Table 3-2. "Isolation Rate of Si in Second Stage (%)" is the isolation rate of the external additives of the toner as a whole. That is, "Isolation Rate of Si in Second Stage (%)" is the isolation rate of the total of the negatively electrifiable silica fine particles and the positively electrifiable silica fine particles (hereinafter referred to as the total isolation rate of positive/negative silica fine particles) liberated in the toner. Accordingly, the isolation rate of the positively electrifiable silica fine particles is presumed by subtracting the isolation rate of Si of the sample processed in step (IV-1) from the total isolation rate of Si of positive/negative silica fine particles.

TABLE 3-3

| | Isolation Rate of Si in First Stage | Isolation Rate of Si in Second Stage | a $Q_1/m_1$ (μC/g) | b $Q_2/m_2$ (μC/g) | c a − b (μC/g) | Occurring Rate of Toner (%) |
|---|---|---|---|---|---|---|
| Example 3-1 Toner 3A | 0.24 | 0.50 | −13.56 | −15.38 | 1.82 | 1.5 |
| Example 3-2 Toner 3B | 0.29 | 0.55 | −12.44 | −15.11 | 2.67 | 2.1 |

TABLE 3-3-continued

| | | Isolation Rate of Si in First Stage | Isolation Rate of Si in Second Stage | a $Q_1/m_1$ (μC/g) | b $Q_2/m_2$ (μC/g) | c a − b (μC/g) | Occurring Rate of Toner (%) |
|---|---|---|---|---|---|---|---|
| Comparative Example 3-1 | Toner 3C | 0.82 | — | −12.66 | −18.32 | 5.66 | 6.2 |
| Comparative Example 3-2 | Toner 3D | 0.31 | 0.93 | −18.99 | −26.52 | 7.53 | 7.1 |

As is apparent from the results in Table 3-3, the isolation rate of Si in the second stage, i.e., the total isolation rate of positive/negative silica fine particles, of Toner 3A (Example 3-1) and Toner 3B (Example 3-2) obtained by the external addition of negatively electrifiable silica fine particles and positively electrifiable silica fine particles in this order was from 0.50 to 0.55%. On the other hand, the total isolation rate of positive/negative silica fine particles of Toner 3C (Comparative Example 3-1) obtained by the external addition of negatively electrifiable silica fine particles and the positively electrifiable silica fine particles at the same time was 0.82%, and the total liberation rate of positive/negative silica fine particles of Toner 3D (Comparative Example 3-2) obtained by the external addition of positively electrifiable silica fine particles and negatively electrifiable silica fine particles in this order was 0.93%. The values in Comparative Examples 3-1 and 3-2 are far higher as compared with those in Examples 3-1 and 3-2.

Since the isolation rates of the positively electrifiable silica fine particles in Examples 3-1 and 3-2 are presumed by (the isolation rate of Si in the second stage)—(the isolation rate of Si in the first stage), the values are both thought to be about 0.26%. Contrary to this, the isolation rate of the positively electrifiable silica fine particles of the toner in Comparative Example 3-2 is 0.31%, and the isolation rate of the negatively electrifiable silica fine particles is presumed to be: 0.93−0.31=0.62(%). The isolation rate of the negatively electrifiable silica fine particles of the third invention is thus extremely low. This shows that negatively electrifiable silica strongly adheres to toner mother particles, in the relationship of the work function, by performing external addition process of negatively electrifiable silica fine particles in the first stage.

Further, to examine the third value c (a-b) in Table 3-3, the values c of the toners in Examples 3-1 and 3-2 are far smaller as compared with the values in Comparative Examples 1 and 2, which shows that the toners in the third invention are excellent in the uniformity of the quantity of electrification. It is also seen that the occurring rates of positive toner in the toners in Examples 3-1 and 3-2 are also far smaller than the occurring rates of positive toner in the toners in Comparative Examples 3-1 and 3-2.

From these results, the third invention has been improved to be capable of providing toners which are excellent in the uniformity of electrification, small in the occurring rate of positive toner and in a preferred range, so that excellent in electrification characteristics, and excellent in flowability.

Example 3-3

Preparation of Toner 3E:

External addition process was performed by adding 2.0 part by weight of RX200 to 100 parts by weight of the toner mother particles obtained above (step (IV-1)). Toner 3E was prepared by the external addition process of adding 0.1 part by weight of NA50H to the external addition processed-product obtained in step (IV-1) (step (IV-2)). The isolation rate of Si, the quantity of electrification, and the occurring rate of the negatively charged toner particles (occurring rate of positive toner (%)) of the obtained Toner 3E were evaluated in the same manner as in the evaluation method of the Toner A to D described above. The process is described in Table 3-4 below.

Example 3-4

Preparation of Toner 3F:

Toner 3F was prepared in the same process as in Example 3-1, except for adding 1.0 part by weight of RX200 and 1.0 part by weight of NA50H to 100 parts by weight of the toner mother particles, and Toner 3F was evaluated in the same manner as in the evaluation method of the Toner A to D described above. The results are shown in Table 3-4 below.

Example 3-5

Preparation of Toner 3G:

Toner 3G was prepared in the same process as in Example 3-1, except for adding 4.0 parts by weight of RX200 and 0.1 part by weight of NA50H to 100 parts by weight of the toner mother particles, and Toner 3G was evaluated in the same manner as in the evaluation method of the Toner A to D described above. The results are shown in Table 3-4 below.

Example 3-6

Preparation of Toner 3H:

Toner 3H was prepared in the same process as in Example 3-1, except for adding 0.5 parts by weight of RX200 and 1.0 part by weight of NA50H to 100 parts by weight of the toner mother particles, and Toner 3H was evaluated in the same manner as in the evaluation method of the Toner A to D described above. The results are shown in Table 3-4 below.

TABLE 3-4

| | | External Additives | | Isolation Rate of Si after | Isolation Rate of Si after | a | b | c | Occurring |
|---|---|---|---|---|---|---|---|---|---|
| | | Step (IV-1) | Step (IV-2) | Step (IV-1) | Step (IV-2) | $Q_1/m_1$ (μC/g) | $Q_2/m_2$ (μC/g) | a − b (μC/g) | Rate of Toner |
| Example 3-3 | Toner 3E | 2.0 | 0.1 | 0.44 | 0.44 | −15.21 | −17.33 | 2.12 | 2.2 |
| Example 3-4 | Toner 3F | 1.0 | 1.0 | 0.29 | 0.55 | −13.36 | −16.38 | 3.02 | 2.6 |
| Example 3-5 | Toner 3G | 4.0 | 0.1 | 0.66 | 0.74 | −17.65 | −23.10 | 5.35 | 1.8 |
| Example 3-6 | Toner 3H | 0.5 | 1.0 | 0.24 | 0.76 | −13.11 | −14.98 | 1.87 | 5.9 |

The numeral in the column of External Additives shows the addition amount (parts by weight) to 100 parts by weight of toner mother particles.

In Examples 3-3 to 3-6, examination was performed by changing the proportion of addition amounts of negatively electrifiable silica fine particles and positively electrifiable silica fine particles. In Examples 3-3 and 3-4, the ratios of the amount of negatively electrifiable silica fine particles/the amount of positively electrifiable silica fine particles are respectively set at 20/1 and 1/1 so as to come to the range of 1/1 to 30/1. In Example 3-5, the ratio is 40/1, and in Example 3-6 the ratio is 1/2.

From the results in Table 3-4, the Si isolation rate after step (IV-2) is small, the uniformity of electrification is excellent, and the occurring rate of positively electrified toner particles is in a preferred range when the ratio of the amount of negatively electrifiable silica fine particles/the amount of positively electrifiable silica fine particles is in the range of 1/1 to 30/1 as in the toners in Examples 3-3 and 3-4 (Toner 3E and Toner 3F). Since Toner 3G in Example 3-5 was high in this ratio and the absolute amount of the negatively electrifiable toner added was large, the Si isolation rate after step (IV-2) was a little high, and the uniformity of electrification was a little inferior to Toner 3F but there was no problem in using the toner. Since the amount of the negatively electrifiable silica fine particles in Toner 3H in Example 3-6 was comparatively small, the Si isolation rate after step (IV-2) of Toner 3H was high, and a little inferior to Toner 3E and Toner 3F in the uniformity of electrification, there was no problem in using the toner.

The fourth invention is illustrated with reference to examples below.

Preparation of Toner Mother Particles of the Fourth Invention:

One hundred (100) parts by weight of a binder resin comprising polyester and 3.5 parts by weight of a red pigment (C.I. 12055) were put into Henschel Mixer FM 20B (a product of MITSUI MINING COMPANY, LIMITED), and homogeneously blended. The mixture was melt-kneaded with a two-shaft kneading extruder PCM-30 (manufactured by IKEGAI KASEI CO., LTD), and after cooling, pulverized by jet air with a jet pulverizer 200AFG (a product of HOSOKAWA MICRON CORPORATION). The pulverized product was classified with a wind power classifier 100ATP. (a product of HOSOKAWA MICRON CORPORATION), to thereby prepare toner mother particles having a volume average particle size of 8.5 μm. The quantity of electrification of the thus-obtained toner mother particles was −12 μC/g.

External Additives:

The external additives externally added to toner mother particles used in Examples of the fourth invention are shown in Table 4-1 below.

TABLE 4-1

| External Additive | Trade Name | | Average Particle Size | Manufacturer |
|---|---|---|---|---|
| 4a Positively electrifiable silica | Positively electrifiable hydrophobic silica | NA50H | 30 nm | Nippon Aerosil Co., Ltd. |
| 4b Titanium oxide | Hydrophobic titanium oxide*) | STT-30S | Long axis: 20 nm | TITAN KOGYO KABUSHIKI KAISHA |
| 4c Long chain fatty acid salt | Magnesium stearate | | | |

*)Rutile-anatase type

External Addition Process:

In the examples of the fourth invention, external addition process was performed by adding predetermined amounts of external additives to 100 parts by weight of toner mother particles, and stirring the constituents by using a Henschel Mixer FM20B (a product of MITSUI MINING COMPANY, LIMITED) for 3 minutes with Z0S0 type stirring blades at 2,000 rpm. In the manufacturing process of Toner 4B, titanium oxide fine particles and particles comprising a long chain fatty acid or a salt thereof respectively in predetermined amounts to 100 parts by weight of the toner mother particles were added to the mixture obtained by externally adding positively electrifiable silica fine particles to toner mother particles, and the mixture was stirred with a Henschel Mixer on the same condition as the external addition condition of positively electrifiable silica fine particles.

Example 4-1

Preparation of Toner 4A:

Toner 4A was prepared by the external addition process of adding 1.0 part by weight of NA50H, 1.0 part by weight of STT-30S and 0.2 part by weight of magnesium stearate powder to 100 parts by weight of the above-obtained toner mother particles. The process is described in Table 4-2 below.

Example 4-2

Preparation of Toner 4B:

External addition process was performed by adding 1.0 part by weight of NA50H to 100 parts by weight of the toner mother particles. Toner 4B was prepared by the external addition process of adding 1.0 part by weight of STT-30S and 0.2 part by weight of magnesium stearate powder to the above-obtained mixture. The process is described in Table 4-2 below.

Comparative Example 4-1

Toner 4C of Comparative Example 4-1 was prepared by the same external addition process as in Example 4-1 except for adding 1.0 part by weight of NA50H and 0.2 part by weight of magnesium stearate powder. The process is described in Table 4-2 below.

Comparative Example 4-2

Toner 4D of Comparative Example 4-2 was prepared by the same external addition process as in Example 4-1 except for adding 1.0 part by weight of NA50H and 1.0 part by weight of STT-30S. The process is described in Table 4-2 below.

Comparative Example 4-3

Toner 4E of Comparative Example 4-3 was prepared by the same external addition process as in Example 4-1 except for adding 1.0 part by weight STT-30S and 0.2 part by weight of magnesium stearate powder, and then externally adding 1.0 part by weight of NA50H. The process is described in Table 4-2 below.

TABLE 4-2

| | External Additives | | | Order of External Addition | | |
|---|---|---|---|---|---|---|
| | a | b | c | First Stage | Second Stage | |
| Example 4-1 | 1.0 | 1.0 | 0.2 | 4a + 4b + 4c | — | Toner 4A |
| Example 4-2 | 1.0 | 1.0 | 0.2 | 4a | 4b + 4c | Toner 4B |
| Comparative Example 4-1 | 1.0 | — | 0.2 | 4a + 4c | — | Toner 4C |
| Comparative Example 4-2 | 1.0 | 1.0 | — | 4a + 4b | — | Toner 4D |
| Comparative Example 4-3 | 1.0 | 1.0 | 0.2 | 4b + 4c | 4a | Toner 4E |

The numeral in the column of External Additives shows the addition amount (parts by weight) to 100 parts by weight of toner mother particles.

Example 4-3

The toners 4A to 4E respectively obtained by the above methods (Table 4-2) were evaluated by the evaluation method described above. The results of the above evaluation are shown in Table 4-3 below.

TABLE 4-3

| | | a $Q_1/m_1$ (μC/g) | b $Q_2/m_2$ (μC/g) | c a − b (μC/g) | Electrical Resistivity (Ω · cm) | Isolation Rate of Silica (%) | Isolation Rate of Titanium Oxide (%) |
|---|---|---|---|---|---|---|---|
| Example 4-1 | Toner 4A | −10.59 | −13.25 | 2.66 | $3.1 \times 10^{16}$ | 0.39 | 0.51 |
| Example 4-2 | Toner 4B | −12.11 | −14.53 | 2.42 | $4.3 \times 10^{16}$ | 0.35 | 0.52 |
| Comparative Example 4-1 | Toner 4C | −14.66 | −19.26 | 6.30 | $9.9 \times 10^{16}$ | 0.45 | — |
| Comparative Example 4-2 | Toner 4D | −13.65 | −19.68 | 6.03 | $5.6 \times 10^{16}$ | 0.46 | 0.89 |
| Comparative Example 4-3 | Toner 4E | −9.25 | −15.73 | 6.48 | $8.3 \times 10^{16}$ | 0.86 | 0.56 |

The results in Table 4-3 show that in the toners obtained by externally adding positively electrifiable silica fine particles, titanium oxide fine particles and particles comprising a long chain fatty acid or a salt thereof (magnesium stearate: metal soap) to negatively electrifiable mother particles at the same time (Example 4-1) or in a specific order (Example 4-2), the isolation of the positively electrifiable silica fine particles and titanium oxide fine particles is restrained, the reduction of the electrical resistivity is controlled, and the electrification is unified without using negatively electrifiable silica fine particles. To compare with the toners obtained by the methods disclosed in patent documents 1 to 3 (Comparative Examples 4-1 and 4-2), the advantage of the fourth invention is apparent in uniformity of electrification, and the isolation rate of positively electrifiable silica fine particles and titanium oxide fine particles.

Example 4-4

A copier (model LP-9300 manufactured by Seiko Epson Corporation) was charged with a toner (Toner 4B) obtained in Example 4-2, or a toner (Toner 4D) obtained in Comparative Example 4-2, and printing of 3,000 sheets was performed. Printing was begun when 5% of each toner was consumed, and the quantity of electrification and the isolation rate of positively electrifiable silica fine particles and titanium oxide fine particles before and after printing were compared. The results obtained are shown in Table 4-4 below.

TABLE 4-4

| | | a $Q_1/m_1$ (μC/g) | b $Q_2/m_2$ (μC/g) | c a − b (μC/g) | Electrical Resistivity (Ω · cm) | Isolation Rate of Silica (%) | Isolation Rate of Titanium Oxide (%) |
|---|---|---|---|---|---|---|---|
| Example 4-2 Toner 4B | Initial stage | −12.11 | −14.53 | 2.42 | $4.3 \times 10^{16}$ | 0.35 | 0.52 |
| | After printing 3,000 sheets | −13.34 | −15.36 | 2.02 | $4.6 \times 10^{16}$ | 0.41 | 0.65 |
| Comparative Example 4-2 Toner 4D | Initial stage | −13.65 | −19.68 | 6.03 | $5.6 \times 10^{16}$ | 0.46 | 0.89 |
| | After printing 3,000 sheets | −21.39 | −30.65 | 9.26 | $4.9 \times 10^{18}$ | 0.88 | 0.91 |

As is apparently seen from the results in Table 4-4, the toner in Example 4-2 (Toner 4B) obtained by externally adding positively electrifiable silica fine particles, titanium oxide fine particles and particles comprising a long chain fatty acid or a salt thereof (magnesium stearate: metal soap) to negatively electrifiable mother particles in a specific order can restrain the fluctuation of the quantity of electrification, the change in the electrical resistivity (increase) and the isolation rate of positively electrifiable silica fine particles and titanium oxide fine particles with the increase of the number of sheets of printing, thus the long term stability of toner can be obtained. On the other hand, in the toner in Comparative Example 4-2 (Toner 4D) wherein magnesium stearate was not used, the quantity of electrification largely changed, the change in the electrical resistivity was conspicuous, and the isolation rate of titanium oxide was great.

The fifth invention is illustrated with reference to examples below.

Preparation of Toner Mother Particles of the Fifth Invention:

One hundred (100) parts by weight of a binder resin comprising styrene-acrylic-based resin or a polyester resin, 3.5 parts by weight of a red pigment (C.I. 12055), and 1.0 part by weight of chromium salicylate complex were put into Henschel Mixer FM 20B (a product of MITSUI MINING COMPANY, LIMITED), and homogeneously blended. The mixture was melt-kneaded with a two-shaft kneading extruder PCM-30 (manufactured by IKEGAI KASEI CO., LTD), and after cooling, pulverized by jet air with a jet pulverizer 200AFG (a product of HOSOKAWA MICRON CORPORATION). The pulverized product was classified with a wind power classifier 100ATP (a product of HOSOKAWA MICRON CORPORATION), to thereby prepare toner mother particles having a volume average particle size of 8.5 μm.

External Additives:

The external additives externally added to toner mother particles in Examples in the fifth invention are shown in Table 5-1 below.

TABLE 5-1

| | External Additive | Trade Name | | Average Particle Size | Manufacturer |
|---|---|---|---|---|---|
| 5a1 | Negatively electrifiable silica | Negatively electrifiable hydrophobic silica | RX200 | 15 nm | Nippon Aerosil Co., Ltd |
| 5a2 | Negatively electrifiable silica | Negatively electrifiable hydrophobic silica | RX50 | 40 nm | Nippon Aerosil Co., Ltd. |
| 5b | Titanium oxide | Hydrophobic titanium oxide*) | STT-30S | Long axis: 20 nm | TITAN KOGYO KABUSHIKI KAISHA |
| 5c | Positively electrifiable silica | Positively electrifiable hydrophobic silica | NA50H | 30 nm | Nippon Aerosil Co., Ltd. |
| 5d | Long chain fatty acid salt | Magnesium stearate | | | |

*)Rutile-anatase type

Examples 5-1 to 5-13 and Comparative Examples 5-1 to 5-7

Each of the toners in Examples 5-1 to 5-13 and Comparative Examples 5-1 to 5-7 was obtained by adding external additives shown in Table 5-2 below each in the predetermined amount and predetermined order as shown in Table 5-2 to 100 parts by weight of toner mother particles comprising a styrene-acrylic resin as the binder resin. The process of external addition was performed by using Henschel Mixer FM20B (a product of MITSUI MINING COMPANY, LIMITED), and stirring the external additives for 3 minutes with Z0S0 type stirring blades, at 2,000 rpm. The process of external addition in each stage was performed on the same condition. The external additives used, the amounts and the addition order are shown in Table 5-2.

TABLE 5-2

| | External Additives | | | | | Order of External Addition | | | |
|---|---|---|---|---|---|---|---|---|---|
| | 5a1 | 5a2 | 5b | 5c | 5d | First Stage | Second Stage | Third Stage | Fourth S ta ge |
| Example 5-1 | 1.0 | — | 0.5 | 0.5 | 0.1 | 5a1 | 5b | 5c | 5d |
| Example 5-2 | 1.0 | — | 0.5 | 0.5 | 0.1 | 5a1 | 5b | 5c + 5d | — |
| Example 5-3 | 0.5 | 0.5 | 0.5 | 0.5 | 0.1 | 5a1 + 5a2 | 5b | 5c + 5d | — |
| Example 5-4 | 1.0 | — | 1.0 | — | 0.2 | 5a1 | 5b | 5d | — |
| Example 5-5 | 1.0 | — | 1.0 | — | 0.2 | 5a1 | 5b + 5d | — | — |
| Example 5-6 | 1.0 | — | 1.0 | 0.5 | 0.1 | 5a1 | 5b + 5c + 5d | — | — |
| Example 5-7 | 0.5 | 0.5 | 1.0 | 0.5 | 0.1 | 5a1 + 5a2 | 5b + 5c + 5d | — | — |
| Example 5-8 | 1.0 | — | 0.5 | 0.5 | 0.2 | 5a1 + 5b | 5c | 5d | — |
| Example 5-9 | 1.0 | — | 0.5 | 0.5 | 0.2 | 5a1 + 5b | 5c + 5d | — | — |
| Example 5-10 | 1.0 | — | 0.5 | 0.5 | 0.2 | 5b | 5a1 | 5c | 5d |
| Example 5-11 | 1.0 | — | 0.5 | 0.5 | 0.2 | 5b | 5a1 | 5c + 5d | — |
| Example 5-12 | 1.0 | — | 0.5 | — | 0.2 | 5b | 5a1 | 5d | — |
| Example 5-13 | 1.0 | — | — | 0.5 | 0.2 | 5a1 | 5c | 5d | — |
| Comparative Example 5-1 | 1.0 | — | 0.5 | 0.5 | — | 5a1 + 5b + 5c | — | — | — |
| Comparative Example 5-2 | 1.0 | — | 0.5 | 0.5 | — | 5a1 | 5c | 5b | — |
| Comparative Example 5-3 | 1.0 | — | 0.5 | — | — | 5a1 | 5b | — | — |
| Comparative Example 5-4 | 1.0 | — | 0.5 | 0.5 | 0.1 | 5a1 + 5b + 5c + 5d | — | — | — |
| Comparative Example 5-5 | 1.0 | — | 1.0 | — | — | 5a1 | 5b | — | — |
| Comparative Example 5-6 | 1.0 | — | 1.0 | — | 0.2 | 5a1 + 5b + 5c | — | — | — |
| Comparative Example 5-7 | 0.5 | 0.5 | 1.0 | 0.5 | 0.1 | 5a1 + 5a2 + 5b + 5c + 5d | — | — | — |

The numeral in the column of External Additives shows the addition amount (parts by weight) to 100 parts by weight of toner mother particles.

The toners obtained in Table 5-2 above were evaluated according to the evaluation methods described above. The results obtained are shown in Table 5-3 below.

TABLE 5-3

| | (i) $Q_1/m_1$ (μC/g) | (ii) $Q_2/m_2$ (μC/g) | (iii) (i) − (ii) (μC/g) | Electrical Resistivity (Ω · cm) | Isolation Rate of Silica (%) | Isolation Rate of Titanium Oxide (%) |
|---|---|---|---|---|---|---|
| Example 5-1 | −11.86 | −12.26 | 0.40 | $4.3 \times 10^{16}$ | 0.38 | 0.46 |
| Example 5-2 | −11.53 | −11.66 | 0.13 | $4.4 \times 10^{16}$ | 0.38 | 0.51 |
| Example 5-3 | −11.56 | −11.69 | 0.13 | $4.1 \times 10^{16}$ | 0.39 | 0.43 |
| Example 5-4 | −12.34 | −14.26 | 1.92 | — | 0.42 | 0.53 |
| Example 5-5 | −12.56 | −13.03 | 0.47 | — | 0.32 | 0.47 |
| Example 5-6 | −12.12 | −16.11 | 3.99 | $4.3 \times 10^{16}$ | 0.39 | 0.49 |
| Example 5-7 | −13.15 | −16.63 | 3.48 | $4.1 \times 10^{16}$ | 0.41 | 0.56 |
| Example 5-8 | −11.22 | −12.56 | 1.44 | $4.7 \times 10^{16}$ | 0.35 | 0.48 |
| Example 5-9 | −12.69 | −13.11 | 0.42 | $4.2 \times 10^{16}$ | 0.36 | 0.47 |
| Example 5-10 | −13.52 | −14.62 | 1.10 | $4.2 \times 10^{16}$ | 0.45 | 0.37 |
| Example 5-11 | −14.62 | −15.88 | 1.26 | $4.2 \times 10^{16}$ | 0.48 | 0.44 |
| Example 5-12 | −14.89 | −16.21 | 1.32 | $4.2 \times 10^{16}$ | 0.37 | 0.46 |
| Example 5-13 | −11.63 | −13.51 | 1.88 | $4.2 \times 10^{16}$ | 0.51 | 0.48 |
| Comparative Example 5-1 | −12.96 | −16.31 | 3.35 | $4.5 \times 10^{16}$ | 0.46 | 1.28 |
| Comparative Example 5-2 | −13.44 | −20.68 | 7.24 | $7.9 \times 10^{15}$ | 0.38 | 0.98 |
| Comparative Example 5-3 | −12.96 | −16.31 | 3.35 | $4.5 \times 10^{16}$ | 0.46 | 1.28 |
| Comparative Example 5-4 | −13.53 | −15.89 | 2.36 | — | 0.55 | 0.89 |
| Comparative Example 5-5 | −13.72 | −19.23 | 5.51 | — | 0.61 | 0.89 |
| Comparative Example 5-6 | −9.22 | −15.89 | 6.67 | $8.9 \times 10^{15}$ | 0.78 | 0.79 |
| Comparative Example 5-7 | −18.74 | −22.56 | 3.82 | $4.5 \times 10^{16}$ | 0.46 | 0.61 |

From the results shown in Table 5-3, it is apparent that the toners obtained by adding a long chain fatty acid or a salt thereof in the last stage can effectively control the isolation of the constituent external additives by the binding effect of the long chain fatty acid or a salt thereof. The electrical resistivities of such toners are also in a proper range. As shown in the column (iii) in Table 5-3, it is apparent that these toners show a uniform electrification property as compared with any comparative example.

For example, it is known that the toners obtained by adding a long chain fatty acid or a salt thereof in the last stage of the multistage process of the fifth invention are low in the isolation rate of silica fine particles and titanium oxide fine particles, especially the isolation rate of titanium oxide fine particles as compared with the samples in Comparative Examples 5-1 to 5-3 and 5-5 and 5-6 wherein a long chain fatty acid or a salt thereof is not added. Further, these toners also show low isolation rate of silica fine particles and titanium oxide fine particles as compared with the samples in Comparative Examples 5-4 and 5-7 wherein a long chain fatty acid or a salt thereof is added by one time addition.

From the comparison of the results in Examples 5-1 to 5-3 and the result in Comparative Example 5-3, it can be seen that the amounts of free silica fine particles and titanium oxide fine particles are reduced (in other words, silica fine particles are efficiently surrounded by toner mother particles) by adding the metal salt of long chain fatty acid (magnesium stearate) after the addition of positively electrifiable silica fine particles (Example 5-1), or by adding the metal salt of long chain fatty acid with positively electrifiable silica fine particles (Examples 5-2 and 5-3) at the same stage. Accordingly, it becomes possible to reduce the fluctuation of electric charge at use time with the lapse of time.

Of these toners, in particular the toners in Examples 5-2 and 5-3 are excellent in the uniformity of electrification, the isolation rate of silica fine particles and titanium oxide fine particles is low and excellent toners. Therefore, it is expected that a uniform electrification property will be maintained at use time.

The samples obtained in Examples 5-2 and 5-3, 5-8 to 5-13 and Comparative Example 5-3 underwent the durability test. The results obtained are shown in Table 5-4 below.

TABLE 5-4

| | | (i) $Q_1/m_1$ (μC/g) | (ii) $Q_2/m_2$ (μC/g) | (iii) (i) − (ii) (μC/g) | Electrical Resistivity (Ω · cm) | Isolation Rate of Silica (%) | Isolation Rate of Titanium Oxide (%) |
|---|---|---|---|---|---|---|---|
| Example 5-2 | Initial stage | −11.53 | −11.66 | 0.13 | $4.4 \times 10^{16}$ | 0.38 | 0.51 |
| | After printing 3,000 sheets | −15.29 | −17.81 | 2.52 | $5.3 \times 10^{16}$ | 0.42 | 0.69 |
| Example 5-3 | Initial stage | −11.56 | −11.69 | 0.13 | $4.1 \times 10^{16}$ | 0.39 | 0.43 |
| | After printing 3,000 sheets | −12.79 | −13.56 | 0.77 | $4.3 \times 10^{16}$ | 0.38 | 0.63 |
| Example 5-8 | Initial stage | −11.22 | −12.56 | 1.44 | $4.2 \times 10^{16}$ | 0.35 | 0.48 |
| | After printing 3,000 sheets | −13.21 | −14.69 | 1.48 | $5.1 \times 10^{16}$ | 0.38 | 0.52 |
| Example 5-9 | Initial stage | −12.69 | −13.11 | 0.42 | $4.7 \times 10^{16}$ | 0.36 | 0.47 |
| | After printing 3,000 sheets | −13.89 | −14.51 | 0.62 | $4.7 \times 10^{16}$ | 0.41 | 0.42 |
| Example 5-10 | Initial stage | −13.52 | −14.62 | 1.10 | $4.2 \times 10^{16}$ | 0.45 | 0.37 |
| | After printing 3,000 sheets | −15.21 | −16.35 | 1.14 | $4.2 \times 10^{16}$ | 0.44 | 0.48 |
| Example 5-11 | Initial stage | −14.62 | −15.88 | 1.26 | $4.2 \times 10^{16}$ | 0.48 | 0.44 |
| | After printing 3,000 sheets | −14.61 | −16.22 | 1.61 | $8.9 \times 10^{16}$ | 0.51 | 0.59 |
| Example 5-12 | Initial stage | −14.89 | −16.21 | 1.32 | $4.2 \times 10^{16}$ | 0.37 | 0.46 |
| | After printing 3,000 sheets | −15.97 | −17.35 | 1.38 | $5.9 \times 10^{16}$ | 0.44 | 0.57 |
| Example 5-13 | Initial stage | −11.63 | −13.51 | 1.88 | $4.2 \times 10^{16}$ | 0.51 | 0.48 |
| | After printing 3,000 sheets | −13.02 | −15.68 | 2.66 | $4.1 \times 10^{16}$ | 0.58 | 0.65 |
| Comparative Example 5-3 | Initial stage | −12.96 | −16.31 | 3.35 | $4.5 \times 10^{16}$ | 0.46 | 1.28 |
| | After printing 3,000 sheets | −14.81 | −19.63 | 4.82 | $6.2 \times 10^{16}$ | 0.49 | 1.58 |

As is apparent from the results in Table 5-4, in any example of the fifth invention, the isolation rate of silica fine particles and titanium oxide fine particles is not so great as in the comparative example even after durability test as compared with the toner in Comparative Example 5-3. Further, the values in column (iii) in Table 5-4 which show the uniformity of electrification also do not so increase as the increase in the comparative example. That is, the uniformity of electrification is maintained better than that in the comparative example even when the number of sheets of printing increases. Thus, in the toners which are obtained by adding the salt of long chain fatty acid in the last stage of the multistage process, the isolation of the external additives from the toner mother particles is prevented by the binding effect of the long chain fatty acid or a salt thereof. As a result, extreme reduction of the electrical resistivity can be avoided and uniform electrification property can be maintained even after the number of sheets of printing has increased.

To compare the toner in Example 5-2 and the toner in Example 5-3, these toners are both little in the isolation of titanium oxide fine particles after printing of 3,000 sheets and uniform electrification property is maintained, but it can be understood that the increase in isolation rate is less in the toner obtained in Example 5-3 wherein negatively electrifiable silica fine particles al and a2 each having different particle size are used in combination than in the toner obtained in Example 5-2 wherein negatively electrifiable silica fine particles each having different particle size are not used. This fact shows that the fluctuations of the quantity of electrification and the electrical resistivity, and the isolation of silica and titanium oxide fine particles with the increase in the number of sheets of printing can be restrained by using two kinds of negatively electrifiable silica fine particles having different sizes respectively in an appropriate weight ratio.

Examples 5-14 to 5-20 and Comparative Examples 5-8 to 5-10

Each of the toners in Examples 5-14 to 5-20 and Comparative Examples 5-8 to 5-10 was obtained by adding external additives shown in Table 5-5 below each in the predetermined amount and predetermined order as shown in Table 5-5 to 100 parts by weight of negatively electrifiable toner mother particles comprising a polyester resin as the binder resin. The process of external addition was performed by using Henschel Mixer FM20B (a product of MITSUI MINING COMPANY, LIMITED), and stirring the external additives for 3 minutes with Z0S0 type stirring blades, at 2,000 rpm. The process of external addition in each stage was performed on the same condition. The external additives used, the amounts and the addition order are shown in Table 5-5.

TABLE 5-5

| | External Additives | | | | Order of External Addition | | | |
|---|---|---|---|---|---|---|---|---|
| | | | | | First | Second | Third | Fourth |
| | 5a1 | 5b | 5c | 5d | Stage | Stage | Stage | S tage |
| Example 5-14 | — | 1.0 | 1.0 | 0.2 | 5c | 5b + 5d | — | — |
| Example 5-15 | 1.0 | 0.5 | 0.5 | 0.2 | 5a1 + 5c | 5b | 5d | — |
| Example 5-16 | 1.0 | 0.5 | 0.5 | 0.2 | 5a1 + 5b + 5c | 5d | — | — |
| Example 5-17 | 1.0 | 0.5 | 0.5 | 0.2 | 5b | 5a1 | 5c | 5d |
| Example 5-18 | 1.0 | 0.5 | 0.5 | 0.2 | 5b | 5a1 | 5c + 5d | — |
| Example 5-19 | 1.0 | — | 0.5 | 0.2 | 5a1 + 5c | 5d | — | — |
| Example 5-20 | — | — | 0.5 | 0.2 | 5c | 5d | — | — |
| Comparative Example 5-8 | — | 1.0 | — | 0.2 | 5c + 5d | — | — | — |
| Comparative Example 5-9 | — | 1.0 | 1.0 | — | 5b + 5c | — | — | — |
| Comparative Example 5-10 | — | 1.0 | 1.0 | 0.2 | 5b + 5d | 5c | — | — |

The numeral in the column of External Additives shows the addition amount (parts by weight) to 100 parts by weight of toner mother particles.

The toners obtained in Table 5-5 above were evaluated according to the evaluation methods described above. The results obtained are shown in Table 5-6 below.

TABLE 5-6

| | (i) $Q_1/m_1$ (μC/g) | (ii) $Q_2/m_2$ (μC/g) | (iii) (i) − (ii) (μC/g) | Electrical Resistivity (Ω · cm) | Isolation Rate of Silica (%) | Isolation Rate of Titanium Oxide (%) |
|---|---|---|---|---|---|---|
| Example 5-14 | −12.11 | −14.53 | 2.42 | $4.3 \times 10^{16}$ | 0.35 | 0.52 |
| Example 5-15 | −15.21 | −17.66 | 2.45 | $4.6 \times 10^{16}$ | 0.43 | 0.45 |
| Example 5-16 | −15.00 | −16.72 | 1.72 | $4.3 \times 10^{16}$ | 0.41 | 0.43 |
| Example 5-17 | −16.23 | −16.51 | 0.28 | $4.6 \times 10^{16}$ | 0.42 | 0.51 |
| Example 5-18 | −15.97 | −16.24 | 0.27 | $4.1 \times 10^{16}$ | 0.45 | 0.47 |
| Example 5-19 | −16.02 | −16.87 | 0.85 | $4.9 \times 10^{16}$ | 0.42 | — |
| Example 5-20 | −17.15 | −17.46 | 0.31 | $4.6 \times 10^{16}$ | 0.51 | — |
| Comparative Example 5-8 | −14.66 | −19.26 | 6.30 | $9.9 \times 10^{16}$ | 0.45 | — |
| Comparative Example 5-9 | −13.65 | −19.68 | 6.03 | $5.6 \times 10^{16}$ | 0.46 | 0.89 |
| Comparative Example 5-10 | −9.25 | −15.73 | 6.48 | $8.3 \times 10^{16}$ | 0.86 | 0.56 |

From the results shown in Table 5-6, it is apparent that the toners obtained by adding a long chain fatty acid or a salt thereof in the last stage can effectively control the isolation of the constituent external additives by the binding effect of the long chain fatty acid or a salt thereof. The electrical resistivities of such toners are also in a proper range. As shown in the column (iii) in Table 5-6, it is apparent that these toners show a uniform electrification property as compared with any comparative example.

For example, it is known that the toners obtained by adding a long chain fatty acid or a salt thereof in the last stage of the multistage process of the fifth invention are low in the isolation rate of silica fine particles and titanium oxide fine particles, especially the isolation rate of titanium oxide fine particles as compared with the samples in Comparative Examples 5-8 and 5-9 which are not subjected to multistage process. Further, when Comparative Example 5-8, wherein a long chain fatty acid or a salt thereof is added by one time addition, and Example 5-20 are compared, it can be seen that the isolation rates of silica fine particles are not so greatly different, but the electrical resistivity of the toner in Example 5-20 is in a proper range and excellent in the uniformity of electrification.

The samples obtained in Examples 5-14 to 5-20 and Comparative Example 5-8 underwent the durability test. The results obtained are shown in Table 5-7 below.

TABLE 5-7

| | | (i) $Q_1/m_1$ (μC/g) | (ii) $Q_2/m_2$ (μC/g) | (iii) (i) − (ii) (μC/g) | Electrical Resistivity (Ω · cm) | Isolation Rate of Silica (%) | Isolation Rate of Titanium Oxide (%) |
|---|---|---|---|---|---|---|---|
| Example 5-14 | Initial stage | −12.11 | −14.53 | 2.42 | $4.3 \times 10^{16}$ | 0.35 | 0.52 |
| | After printing 3,000 sheets | −13.34 | −15.36 | 2.02 | $4.6 \times 10^{16}$ | 0.41 | 0.65 |
| Example 5-15 | Initial stage | −15.21 | −17.66 | 2.45 | $4.6 \times 10^{16}$ | 0.43 | 0.45 |
| | After printing 3,000 sheets | −16.66 | −17.65 | 0.99 | $5.1 \times 10^{16}$ | 0.46 | 0.51 |
| Example 5-16 | Initial stage | −15.00 | −16.72 | 1.72 | $4.3 \times 10^{16}$ | 0.41 | 0.43 |
| | After printing 3,000 sheets | −16.10 | −17.06 | 0.96 | $4.1 \times 10^{16}$ | 0.50 | 0.46 |
| Example 5-17 | Initial stage | −16.23 | −16.51 | 0.28 | $4.6 \times 10^{16}$ | 0.42 | 0.51 |
| | After printing 3,000 sheets | −17.35 | −18.06 | 0.71 | $4.9 \times 10^{16}$ | 0.42 | 0.55 |
| Example 5-18 | Initial stage | −15.97 | −16.24 | 0.27 | $4.1 \times 10^{16}$ | 0.45 | 0.47 |
| | After printing 3,000 sheets | −17.05 | −17.85 | 0.80 | $2.4 \times 10^{16}$ | 0.50 | 0.59 |
| Example 5-19 | Initial stage | −16.02 | −16.87 | 0.85 | $4.9 \times 10^{16}$ | 0.42 | 0.09 |
| | After printing 3,000 sheets | −17.21 | −17.49 | 0.28 | $5.3 \times 10^{16}$ | 0.44 | 0.10 |
| Example 5-20 | Initial stage | −17.15 | −17.46 | 0.31 | $4.6 \times 10^{16}$ | 0.51 | 0.08 |
| | After printing 3,000 sheets | −18.25 | −18.69 | 0.44 | $4.2 \times 10^{16}$ | 0.59 | 0.09 |
| Comparative Example 5-8 | Initial stage | −13.65 | −19.68 | 6.03 | $5.6 \times 10^{16}$ | 0.46 | 0.89 |
| | After printing 3,000 sheets | −21.39 | −30.65 | 9.26 | $4.9 \times 10^{16}$ | 0.88 | 0.91 |

As is apparent from the results in Table 5-7, in any example of the fifth invention, the isolation rate of silica fine particles and titanium oxide fine particles is not so great as in the comparative example even after durability test as compared with the toner in Comparative Example 5-8. Further, the values in column (iii) in Table 5-7 which show the uniformity of electrification also do not so increase as the increase in the comparative example. That is, the uniformity of electrification is maintained better than that in the comparative example even when the number of sheets of printing increases. Thus, in the toners which are obtained by adding the salt of long chain fatty acid in the last stage of the multistage process, the isolation of the external additives from the toner mother particles is prevented by the binding effect of the long chain fatty acid or a salt thereof. As a result, uniform electrification property can be maintained even after the number of sheets of printing has increased.

As described above, according to the first invention, a toner obtained by the external addition of, to toner mother particles, negatively electrifiable silica fine particles, titanium oxide fine particles, and positively electrifiable silica fine particles in this order; negatively electrifiable silica fine particles, titanium oxide fine particles, positively electrifiable silica fine particles, and particles comprising a long chain fatty acid or a salt thereof in this order; or negatively electrifiable silica fine particles, titanium oxide fine particles, and positively electrifiable silica fine particles and particles comprising a long chain fatty acid or a salt thereof in this order, is uniform in the electrification property, is restrained in the isolation of silica fine particles or titanium oxide fine particles, can maintain a stable electrification property for a long period of time, and is excellent in flowability.

As described above, according to the second invention, since the toners obtained by externally adding negatively electrifiable silica fine particles to toner mother particles in the first place, and then titanium oxide fine particles, positively electrifiable silica fine particles and particles comprising a long chain fatty acid or a salt thereof at the same time can adjust the electric charge of the toners without extremely lowering the electrical resistance value of the toner, the electrification property becomes uniform, and the isolation of silica fine particles and titanium oxide fine particles can also be suppressed by the addition of the binding effect of the long chain fatty acid or a salt thereof. As a result, a stable electrification property and excellent flowability can be maintained for a long period of time.

As described above, according to the third invention, the toner obtained by externally adding negatively electrifiable silica fine particles and positively electrifiable silica fine particles in this order to toner mother particles is excellent in the uniformity of electrification, small in the occurring rate of positive toner, so that excellent in electrification characteristics, and excellent in flowability.

As described above, according to the fourth invention, a toner obtained by adding positively electrifiable silica fine particles, titanium oxide fine particles and particles comprising a long chain fatty acid or a salt thereof (magnesium stearate: metal soap) to negatively electrifiable mother particles at the same time, and a toner obtained by externally adding titanium oxide fine particles and particles comprising a long chain fatty acid or a salt thereof after positively electrifiable silica fine particles have been added are excellent in the restraint of the liberation rate of positively electrifiable silica fine particles and titanium oxide fine particles, the reduction of electrical resistivity is restrained in these toners, and they are excellent in uniformity of electrification. Further, the change in the quantity of electrification, the change in the electrical resistivity (increase) and the isolation of positively electrifiable silica fine particles and titanium oxide fine particles with the increase of the number of sheets of printing can be prevented, thus the long term stability of toner can be obtained. Further, since it becomes possible to obtain good electrification characteristics and flowability without using negatively electrifiable silica fine particles, the set temperature of a fixing chamber in fixing a toner can be made low, and at the same time, good image strength can be ensured.

As described above, according to the fifth invention, the toner in the fifth invention is obtained by adding a long chain fatty acid or a salt thereof in the last stage of the multistage process. It is thought that, by adding in the last stage, the long chain fatty acid or a salt thereof functions as the binding agent of external additives, e.g., negatively electrifiable silica fine particles, positively electrifiable silica fine particles, and titanium oxide fine particles, and restrains the isolation of these external additives from the toner surface. It is also thought that the effect of the long chain fatty acid or a salt thereof as the lubricant of the toner is further exhibited and the uniformity of electrification is maintained by adding the long chain fatty acid or a salt thereof in the last stage. Further, the stability of electrification of the toner of the fifth invention is maintained in repeating use. This is presumed to be the result that the long chain fatty acid or a salt thereof prevents the coagulation of the toner as the lubricant, and the external additives are prevented from being buried in toner mother particles due to the friction of toner particles. Further, it is thought that the toner is brought into contact with the photosensitive material in the developing chamber, thereby the long chain fatty acid or a salt thereof migrates to the surface of the photosensitive material and lubricates the surface of the photosensitive material, as a result, the photosensitive material is prevented from being abraded by the external additives on the surface of the toner.

While the present invention has been described in detail and with reference to specific embodiments thereof, it will be apparent to one skilled in the art that various changes and modifications can be made therein without departing the spirit and scope thereof.

The present application is based on Japanese Patent Application No. 2003-009905, No. 2003-028678, No. 2003-28679, No. 2003-029571 and No. 2003-038280 filed on Jan. 17, 2003, Feb. 5, 2003, Feb. 5, 2003, Feb. 6, 2003, and Feb. 17, 2003, respectively and the contents thereof are incorporated herein by reference.

What is claimed is:

1. A toner obtained by a process comprising, in the following order:

a step of externally adding negatively electrifiable silica fine particles to toner mother particles containing a binder resin and a colorant;

a step of externally adding titanium oxide fine particles;

a step of externally adding positively electrifiable silica fine particles; and a step of externally adding particles comprising a long chain fatty acid or a salt thereof, wherein the titanium oxide fine particles are rutile-anatase type titanium oxide fine particles having a long axis length of 10 to 30 nm, the isolation rate of the titanium oxide fine particles is 0.7% or less, and the isolation rate of the negatively electrifiable silica fine particles and the positively electrifiable silica fine particles is 0.43% or less.

2. The toner according to claim 1, wherein the negatively electrifiable silica fine particles comprise two kinds of negatively electrifiable silica fine particles having different average particle sizes from each other, and the addition amount ratio of the negatively electrifiable silica fine particles having a larger average particle size to the negatively electrifiable silica fine particles having a smaller average particle size is 1/3 to 3/1 by weight.

3. The toner according to claim 1, wherein the titanium oxide fine particles and the positively electrifiable silica fine particles are externally added in a weight ratio thereof of from 1/3 to 3/1.

4. An image-forming apparatus comprising:

a toner according to claim 1;

a latent image carrier on which an electrostatic latent image is formed;

a toner carrier for carrying the toner to the latent image carrier for developing the electrostatic latent image on the latent image carrier; and a development unit having a toner regulating member to regulate the amount of the toner carried to the latent image carrier by the toner carrier.

5. A toner comprising negatively electrifiable toner mother particles having externally added thereto:

positively electrifiable silica fine particles;

titanium oxide fine particles; and particles comprising a long chain fatty acid or a salt thereof, wherein the titanium oxide fine particles are rutile-anatase type titanium oxide fine particles having a long axis length of 10 to 30 nm, the isolation rate of the titanium oxide fine particles is 0.7% or less, and the isolation rate of the negatively electrifiable silica fine particles and the positively electrifiable silica fine particles is 0.43% or less.

6. The toner according to claim 5, wherein the toner mother particles have a quantity of electrification of from −5 to −60 μC/g.

7. The toner according to claim 5, wherein the positively electrifiable silica fine particles, titanium oxide fine particles, and particles comprising a long chain fatty acid or a salt thereof are externally added to the toner mother particles at the same time.

8. The toner according to claim 5, wherein the toner is obtained by a process comprising, in the following order:

a step of externally adding the positively electrifiable silica fine particles; and a step of externally adding the titanium oxide fine particles and particles comprising a long chain fatty acid or a salt thereof.

9. The toner according to claim 5, wherein the positively electrifiable silica fine particles and the titanium oxide fine particles are added in a weight ratio thereof of from 1/3 to 3/1.

10. An image-forming apparatus comprising:

a toner according to claim 5;

a latent image carrier on which an electrostatic latent image is formed;

a toner carrier for carrying the toner to the latent image carrier for developing the electrostatic latent image on the latent image carrier; and a development unit having a toner regulating member to regulate the amount of the toner carried to the latent image carrier by the toner carrier.

* * * * *